US010024046B2

(12) United States Patent
Higginbotham

(10) Patent No.: US 10,024,046 B2
(45) Date of Patent: Jul. 17, 2018

(54) BRACING BRACKET SYSTEM

(71) Applicant: HDG, INC., Alpharetta, GA (US)

(72) Inventor: Gary Higginbotham, Alpharetta, GA (US)

(73) Assignee: HDG, INC., Alpharetta, GA (US)

( * ) Notice: Subject to any disclaimer, the term of this patent is extended or adjusted under 35 U.S.C. 154(b) by 0 days.

(21) Appl. No.: 15/237,462

(22) Filed: Aug. 15, 2016

(65) Prior Publication Data

US 2017/0044752 A1 Feb. 16, 2017

Related U.S. Application Data

(60) Provisional application No. 62/205,377, filed on Aug. 14, 2015.

(51) Int. Cl.

| | |
|---|---|
| ***E04B 1/26*** | (2006.01) |
| ***E04B 1/00*** | (2006.01) |
| ***E04B 5/12*** | (2006.01) |

(52) U.S. Cl.

CPC ..... *E04B 1/003* (2013.01); *E04B 5/12* (2013.01); *E04B 1/2608* (2013.01); *E04B 2001/2644* (2013.01)

(58) Field of Classification Search

CPC ..... E04B 1/003; E04B 2001/2644; E04B 1/2608; E04B 5/12; E04B 1/043; E04B 1/5818; E04C 3/02

See application file for complete search history.

(56) References Cited

U.S. PATENT DOCUMENTS 1,346,131 A * 7/1920 Marqua ..... E04G 17/16 403/187
3,342,005 A * 9/1967 Rickards ..... E04F 13/0846 52/378
5,186,571 A * 2/1993 Hentzschel ..... E04B 1/2608 256/65.06
6,494,639 B1 * 12/2002 Friend ..... E04B 1/043 403/205

(Continued)

FOREIGN PATENT DOCUMENTS

CA 2531402 A1 * 8/2006 ..... E04B 1/2608
CA 2531402 A1 * 8/2006 ..... E04B 1/2608

(Continued)

*Primary Examiner* — Paola Agudelo
*Assistant Examiner* — Omar F Hijaz
(74) *Attorney, Agent, or Firm* — Robert R. Elliott, Jr.; Lee & Hayes, PLLC

(57) ABSTRACT

A system for mounting a ledger board to a rim board is disclosed. A rim bracket can be affixed to the rim board of a structure using one or more fasteners and includes one or more mounting bolt holes to provide a template for drilling mounting bolt holes in the rim board. The ledger bracket can be attached to a ledger board using one or more fasteners and the rim bracket using one or more fasteners. The ledger bracket can include one or more complementary mounting bolt holes to provide a template for drilling mounting bolts holes in the ledger board. The ledger bracket can be attached to the rim bracket to support the ledger board while one or more mounting bolts are installed through the ledger board, ledger bracket, rim bracket, and rim board to attach the ledger board to the structure.

11 Claims, 21 Drawing Sheets

(56) References Cited

U.S. PATENT DOCUMENTS

| | | | | |
|---|---|---|---|---|
| 6,550,200 | B1 * | 4/2003 | Mueller | E04B 1/26 403/190 |
| 7,104,024 | B1 * | 9/2006 | diGirolamo | E04B 2/767 403/231 |
| 8,607,515 | B2 * | 12/2013 | Jarvis | E04B 1/0038 403/258 |
| 8,898,993 | B2 | 12/2014 | Rodgers | |
| 9,206,594 | B1 * | 12/2015 | Grevious | F16B 5/0614 |
| 2006/0130414 | A1 * | 6/2006 | Walther | E04B 1/003 52/289 |

FOREIGN PATENT DOCUMENTS

| | | | | |
|---|---|---|---|---|
| EP | 2194201 | A2 * | 6/2010 | E04B 1/26 |
| EP | 2194201 | A2 * | 6/2010 | E04B 1/26 |
| WO | WO 2009070117 | A1 * | 6/2009 | E04B 1/2608 |
| WO | WO-2009070117 | A1 * | 6/2009 | E04B 1/2608 |

* cited by examiner

200

250

700

1000

1400

BRACING BRACKET SYSTEM

CROSS REFERENCE TO RELATED APPLICATIONS AND PRIORITY CLAIM

This Application is a non-provisional of, and claims priority under 35 USC § 119(e) to, U.S. Provisional Patent Application No. 62/205,377, filed Aug. 14, 2015, of the same title, the entirety of which is hereby incorporated by reference as if fully set forth below.

BACKGROUND

Examples of the present disclosure are related generally to structural brackets for buildings, and specifically to brackets for installing and supporting a variety of structures to residential and commercial buildings including decks for residential applications.

Numerous structures can be attached to the outside of residential building including, but not limited to, decks, overhangs, awnings, and roofs. These features are often installed ten or more feet above the ground. As a result, failure of the attachment system between the deck and the building, for example, has resulted in property damage, injury, and even death. Traditionally, decks have been attached to structures (e.g., houses or commercial buildings) with bolts, screws, or other means attaching a deck ledger board to an exterior wall or rim board of the building. The deck ledger is generally parallel to, and fastened to, the rim board of the structure. To save time and money, however, some builders may attach the ledger board directly to the brick, stone, or siding by screws or lag bolts. Attachment to these veneer-type surfaces, which are intended only to provide an aesthetically pleasing building exterior, is structurally unsound and violates local and national building codes.

Because of the risk of "pull-out," or detachment of the deck structure from the building, caused by improper installation techniques, most local and national building codes require that the deck ledger board be through-bolted to the rim board with suitable bolts, nuts, and washers. This is achieved by drilling through the rim board and the ledger board and then bolting them together. Due to the weight and size of the ledger board, this can entail some skill and/or multiple workers to hold the ledger board in place while the mounting holes are being drilled through both boards. Drilling through both boards at the same time, however, enables the bolt holes to align in both boards. Due to the extra time and manpower required, however, some builders may avoid this step despite code requirements.

What is needed, therefore, is a structural system that enables the ledger board, and other deck components, to be attached to the building in a manner consistent with local and/or national building codes. The system should enable quick and precise installation of the ledger board, deck structure, guard or hand rails, and other components, while reducing or maintaining the cost and labor required for installation (i.e., over improper, or "non-conforming" techniques). It is to such systems and methods that examples of the present disclosure are primarily directed.

SUMMARY

Examples of the present disclosure relate to a plurality of structural brackets for use with building construction. The brackets can enable structures, such as decks, roofs, overhangs, and awnings to be attached to buildings to meet local and/or national building codes. The system can enable the accurate drilling of mounting bolts holes and other attachment points for railings, corner boards, and other components.

The system can include a rim bracket that can be affixed to the rim board of a structure using one or more fasteners. The rim bracket can include one or more mounting bolt holes to provide a template for drilling mounting bolt holes in the rim board of the building. The system can also include a ledger bracket that can be attached to a ledger board using one or more fasteners and to the rim bracket using one or more fasteners. The ledger bracket can include one or more complementary mounting bolt holes to provide a template for drilling mounting bolts holes in the ledger board. The ledger bracket can be attached to the rim bracket to support the ledger board while one or more mounting bolts are installed. The mounting bolts can be installed through the ledger board, ledger bracket, rim bracket, and rim board to attach the ledger board to the structure.

The system can also include one or more corner brackets. In some examples, a corner bracket can be provided to tie the ledger board and corner joist together at the corner of a deck or other structure. The system can also include an outer corner bracket to enable the rim joist, outer joist, and/or rail posts to be attached to a support post using one or more mounting bolts. Similarly, a multi-level outside corner bracket can enable the rim joist, outer joist, and/or rail posts to be attached to a support post that also provides support for a second story or roof using one or more mounting bolts.

These and other objects, features and advantages of the present invention will become more apparent upon reading the following specification in conjunction with the accompanying drawing figures.

DETAILED DESCRIPTION OF THE INVENTION

Examples of the present disclosure relate to a series of structural brackets used to support a deck, roof, or awning that is attached to the exterior wall of a structure, such as a brick veneered or siding clad house. The structural bracket system provides bracing for the exterior deck and hand rail posts that creates a code compliant (e.g., the International Residential Code (IRC) and/or International Building Code (IBC) code compliant) rigid structure. The system includes brackets for attaching the ledger board, joists, rails, and other components to a building. The brackets can be used in combination, or alone, to provide improved rigidity, alignment, and to reduce installation time and cost.

As discussed above, one issue with properly installing ledger boards and other components, whether they be for decks or other structures, is that it is sometimes difficult to both support the ledger board and to drill holes through the ledger board and the rim board for mounting. This operation can be difficult because, for example, these boards tend to be fairly long and heavy. In addition, it can sometimes be difficult to hold the boards stationary with respect to one another while drilling the multiple bolt holes required. Thus, the level of skill and expense required for this operation can be higher than simply screwing the ledger board to the rim board with deck screws, for example. For safety and code reasons, however, simply screwing the ledger board to the rim board is undesirable.

Figure 1A:
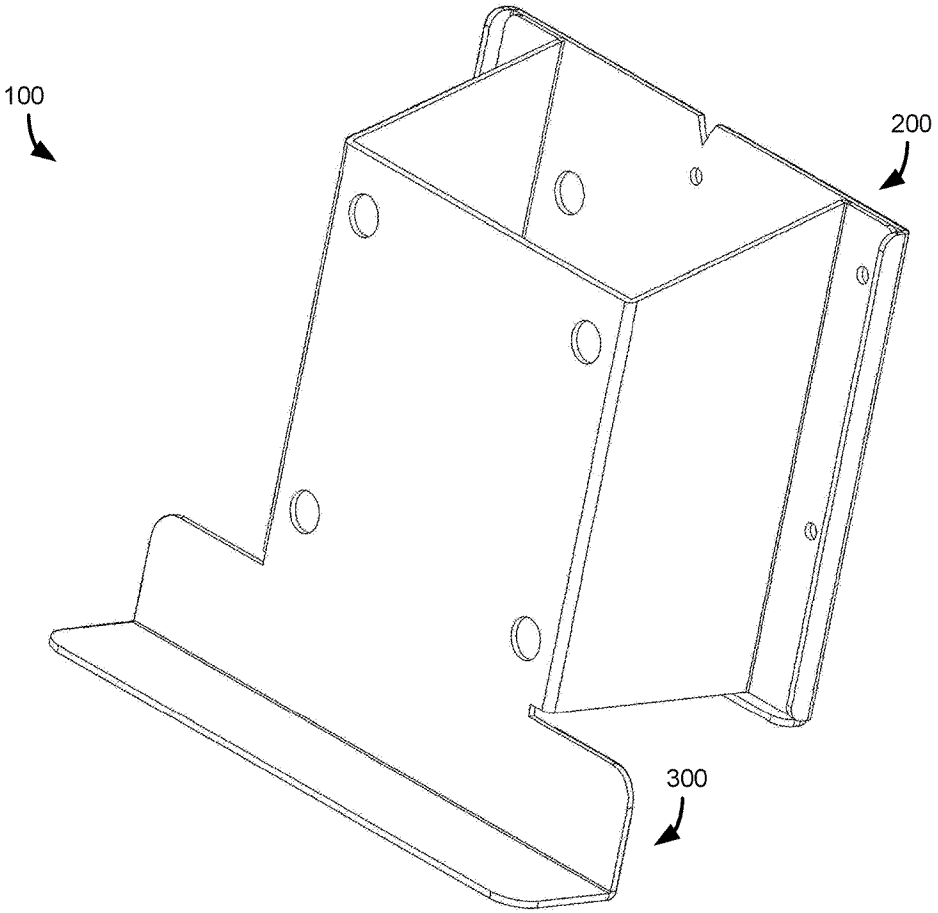
FIG. 1A is a perspective view of a splicing ledger board mounting bracket system, in accordance with some examples of the present disclosure.

To this end, FIG. 1A depicts a splicing ledger board subsystem 100 for installing a two ledger boards, or splicing two ledger boards together, on a rim board. The splicing ledger board subsystem 100 can comprise, for example, a splicing rim bracket 200, and a splicing ledger bracket 300. As will be discussed in greater detail below, the splicing rim bracket 200 can be temporarily attached to the rim board of the structure and can act as a template for drilling holes through the rim board. The splicing rim bracket 200 can also provide a mounting flange to support the splicing ledger bracket 300 during installation. The splicing rim bracket 200 and splicing ledger bracket 300 can be configured such that they are substantially self-aligning to enable quick and precise alignment between the mounting bolt holes in both brackets 200, 300 and both boards (i.e., the ledger board and the rim board).

As discussed in more detail below, the splicing rim bracket 200 can be attached to the rim board using one or more fasteners. The splicing rim bracket 200 can then be used as a template to drill a plurality of mounting holes in the rim board. The splicing ledger bracket 300 can then be attached to the splicing rim bracket 200 using a plurality of fasteners. The splicing ledger bracket 300, in turn, can include a ledge for supporting the ledger boards until they are bolted to the rim board (through both the splicing ledger bracket 300 and the splicing rim bracket 200). The splicing ledger bracket 300 can be used where two ledger boards meet (e.g., on a long deck) to splice them together. As a result, two mounting holes can be used in each ledger board splicing them together.

Figure 1B:
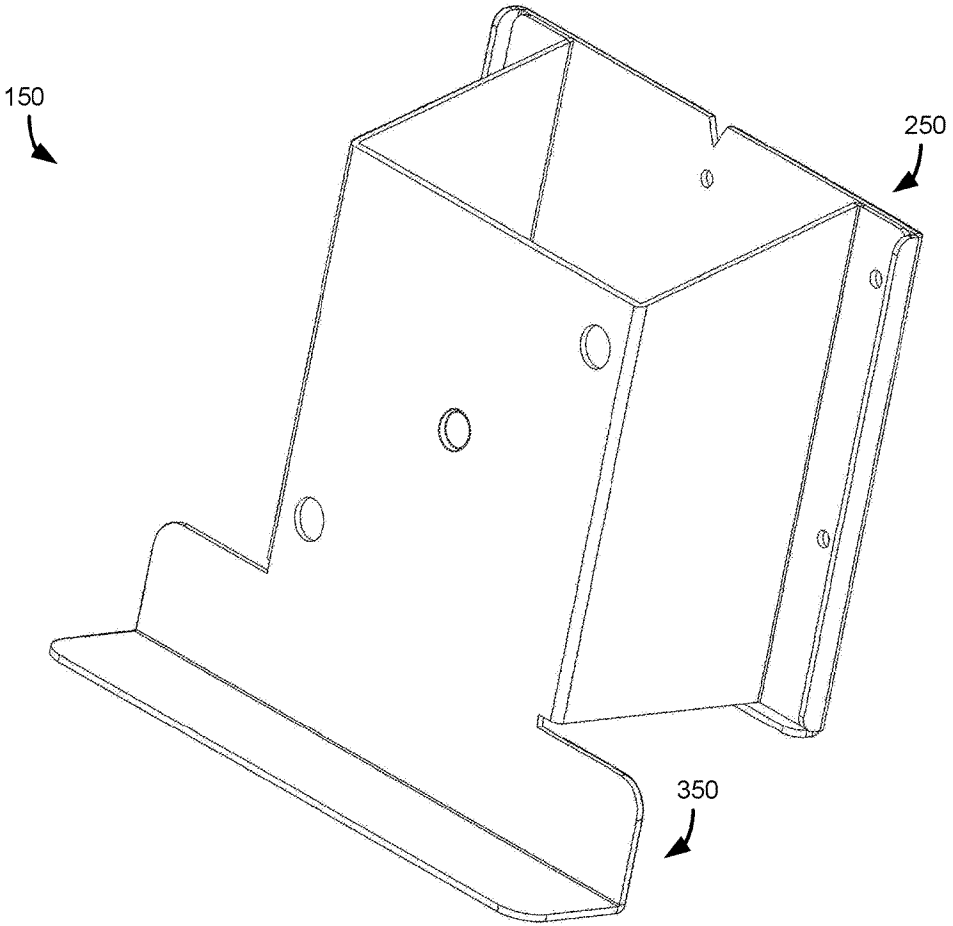
FIG. 1B is a perspective view of a non-splicing ledger board mounting bracket system, in accordance with some examples of the present disclosure.

As shown in FIG. 1B, examples of the present disclosure can also comprise a non-splicing ledger board subsystem 150. The non-splicing ledger board subsystem 150 can be used when a single ledger board is used across the length of a deck, or in the middle of a ledger board when multiple ledger boards are needed. In other words, the non-splicing ledger board subsystem 150 can be used anywhere two ledger boards do not meet. As discussed below, the non-splicing ledger board subsystem 150 can include a non-splicing rim bracket 250 and a non-splicing ledger bracket 350.

Figure 2A:
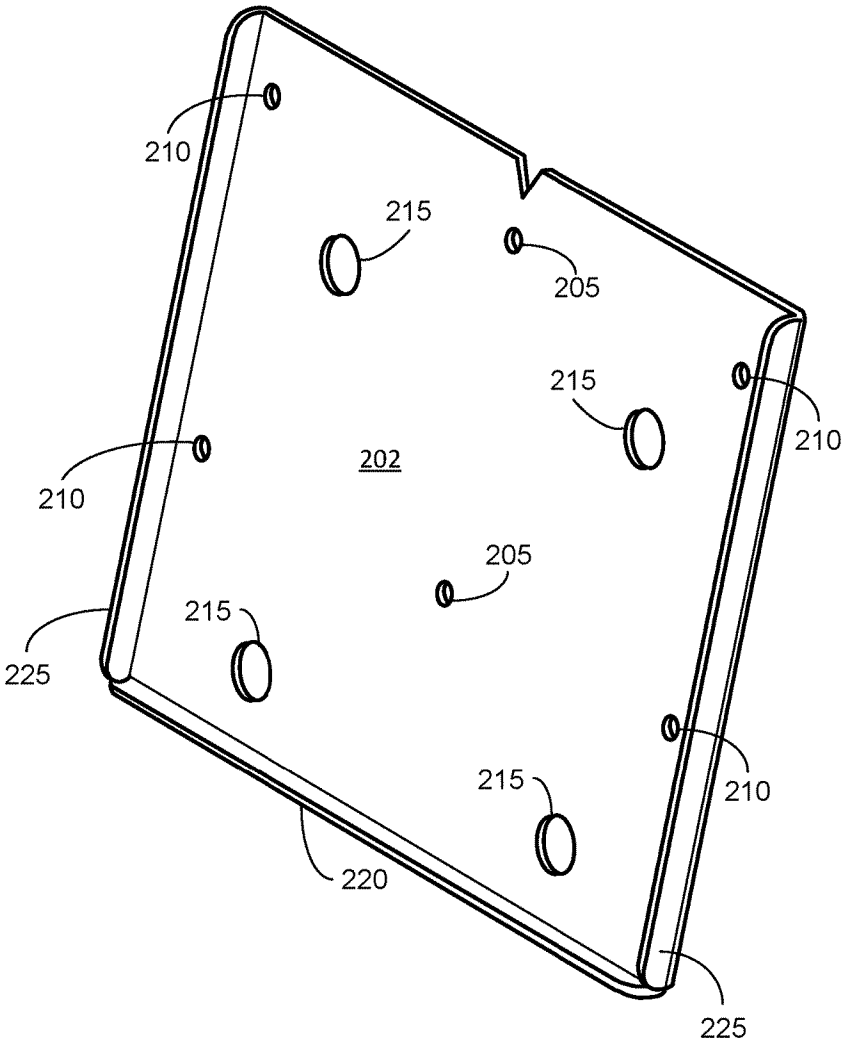
FIG. 2A is a perspective view of a splicing rim bracket, in accordance with some examples of the present disclosure.

As shown in FIG. 2A, the splicing rim bracket 200 can comprise a main body 202 defining multiple mounting holes, or apertures, including one or more temporary mounting holes 205, one or more ledger bracket mounting holes 210, and one or more rim board mounting holes 215. As the name implies, the temporary mounting holes 205 can be used to temporarily mount the splicing rim bracket 200 to the rim board of the structure. This can enable the splicing rim bracket 200 to be mounted on the rim board such that it is plumb and level, for example, and located at the correct height and in the correct position along the rim board. The can enable the splicing ledger board subsystem 100 to be mounted without the difficulty of having to hold large brackets or large pieces of lumber in place while drilling holes and tightening fasteners, among other things.

As discussed below, the splicing rim bracket 200 can also comprise one or more ledger bracket mounting holes 210. As the name implies, the ledger bracket mounting holes 210 can enable the splicing ledger bracket 300 to be mounted to the splicing rim bracket 200. In this manner, the splicing ledger bracket 300 can be temporarily supported and aligned with the splicing rim bracket 200. In some examples, the splicing rim bracket 200 can also comprise one or more rim board mounting holes 215. The rim board mounting holes 215 can correspond to complementary holes in the splicing ledger bracket 300 to enable properly aligned holes to be drilled through the ledger boards, splicing ledger bracket 300, splicing rim bracket 200, and rim board. In this case, the splicing rim bracket 200 can include four holes, for example, to enable two bolts to be placed in each of two ledger boards, splicing the ledger boards together.

The splicing rim bracket 200 can also comprise one or more lips 220, 225 disposed around the perimeter of the splicing rim bracket 200. The bottom lip 220 can support the splicing ledger bracket 300 while it is being attached to the splicing rim bracket 200. This can maintain the vertical alignment of the splicing rim bracket 200 and the splicing ledger bracket 300 during installation. In some examples, the splicing rim bracket 200 can also include one or more side lips 225. The side lips 225 can provide horizontal alignment of the splicing rim bracket 200 and the splicing ledger bracket 300 during installation. In some examples, the tolerances between the lips 220, 225 and the splicing ledger bracket 300 can be minimized (e.g., less than 0.125") to provide accurate alignment of the splicing rim bracket 200, splicing ledger bracket 300, and lumber.

In some examples, the lips 220, 225 can be, for example, bent, molded, or cast into the splicing rim bracket 200, such that the lips 220, 225 are integral to the splicing rim bracket 200 (i.e., the splicing rim bracket 200 and the lips 220, 225 are made from a single piece of material). In other examples, the lips 220, 225 can be manufactured from separate pieces that are, for example, welded, bolted, adhered, screwed, or otherwise attached to the splicing rim bracket 200. In still other embodiments, rather than running the length and width of the splicing rim bracket 200, the lips 220, 225 can comprise tabs, fingers, or teeth disposed on the perimeter of the splicing rim bracket 200.

Figure 2B:
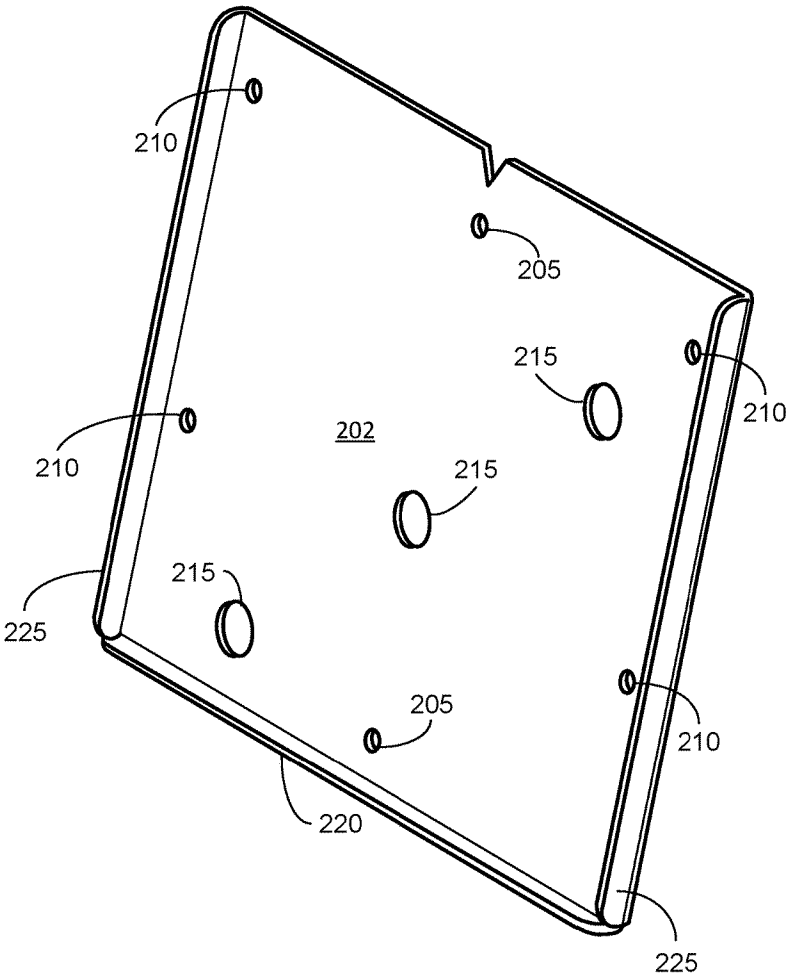
FIG. 2B is a perspective view of a non-splicing rim bracket, in accordance with some examples of the present disclosure.

As shown in FIG. 2B, the non-splicing rim bracket 250 can be substantially the same as the splicing rim bracket 200 with the exception of the number of mounting holes 215. As shown, since the non-splicing rim bracket 250 is not being used (in conjunction with a splicing ledger bracket 300) to splice two ledger boards together, the non-splicing rim-bracket 250 may have fewer mounting holes 215 or an odd number of mounting holes 215. In some examples, the non-splicing rim board 350 can have three mounting holes 215 in a diagonal pattern. Of course, more or less mounting holes 215 and different patterns could also be used depending on the structural requirements for a particular deck, for example.

Figure 3A:
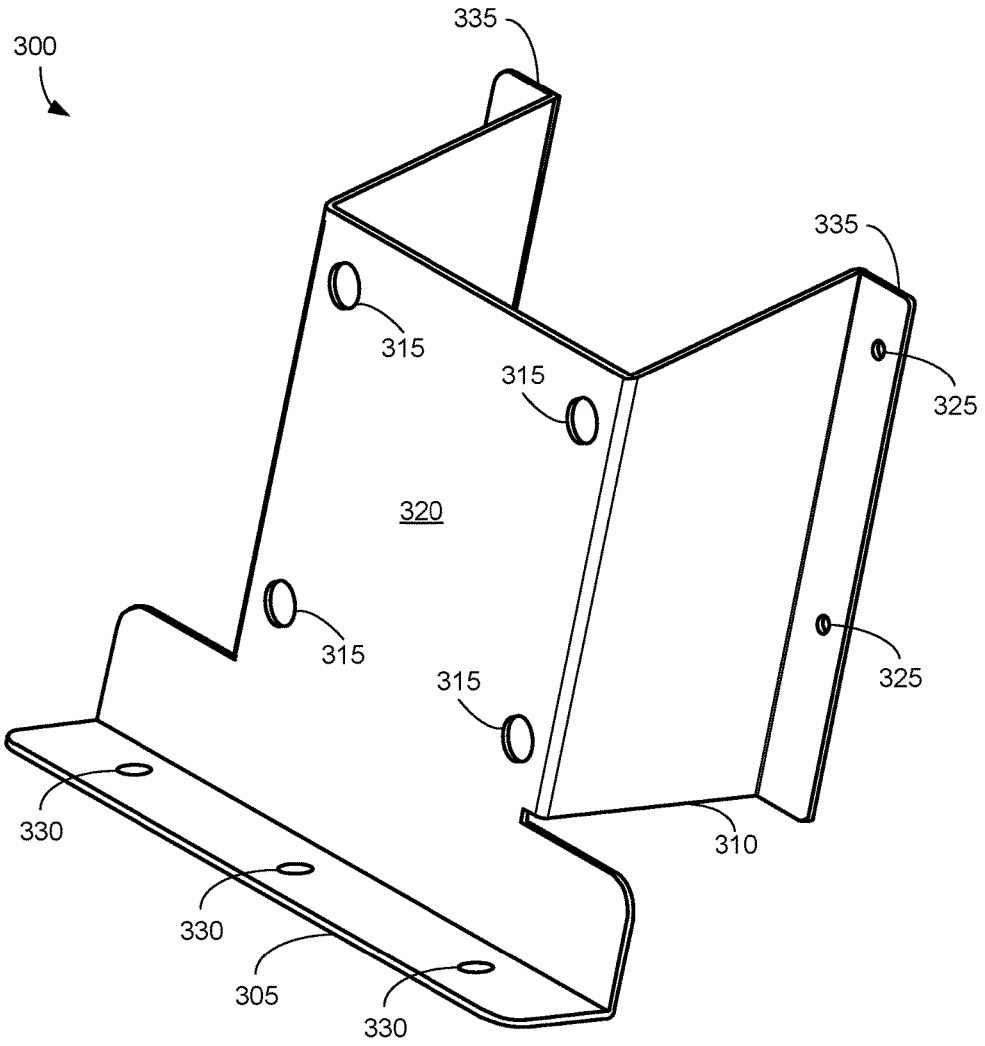
FIG. 3A is a perspective view of a splicing ledger bracket, in accordance with some examples of the present disclosure.

As shown in FIG. 3A, the splicing ledger bracket 300 can comprise a ledge 305 for supporting two ledger boards, one or more extensions 310, one or more mounting flanges 335, and a face plate 320. The mounting flanges 335 can enable the splicing ledger bracket 300 to be attached to the splicing rim bracket 200 using one or more complementary mounting holes 325. In this manner, the splicing ledger bracket 300 can be temporarily attached to the splicing rim bracket 200 using, for example, deck or drywall screws to hold the brackets 200, 300 in place while the mounting holes are drilled and the ledger boards are bolted to the structure.

In some examples, the splicing ledger bracket 300 can also comprise a ledge 305 on which the ledger boards can be supported. This can enable the ledger boards to be lifted into place, but then supported by the splicing ledger board subsystem 100 while the ledger boards are being bolted to the structure. The ledge 305 can also comprise one or more ledger board mounting holes 330 to temporarily attach the ledger boards to the splicing ledger bracket 300. In some examples, as described below, this can enable the ledger boards to be attached to the splicing ledger bracket 300 to drill the mounting bolt holes 315 prior to attaching the splicing ledger bracket 300 to the splicing rim bracket 200. In this manner, the splicing ledger bracket 300 can act as a template for the ledger bracket mounting holes 315 in the ledger boards and the splicing rim bracket 200 can act as a template for the complementary rim board mounting holes 215 on the rim board.

Figure 4A:
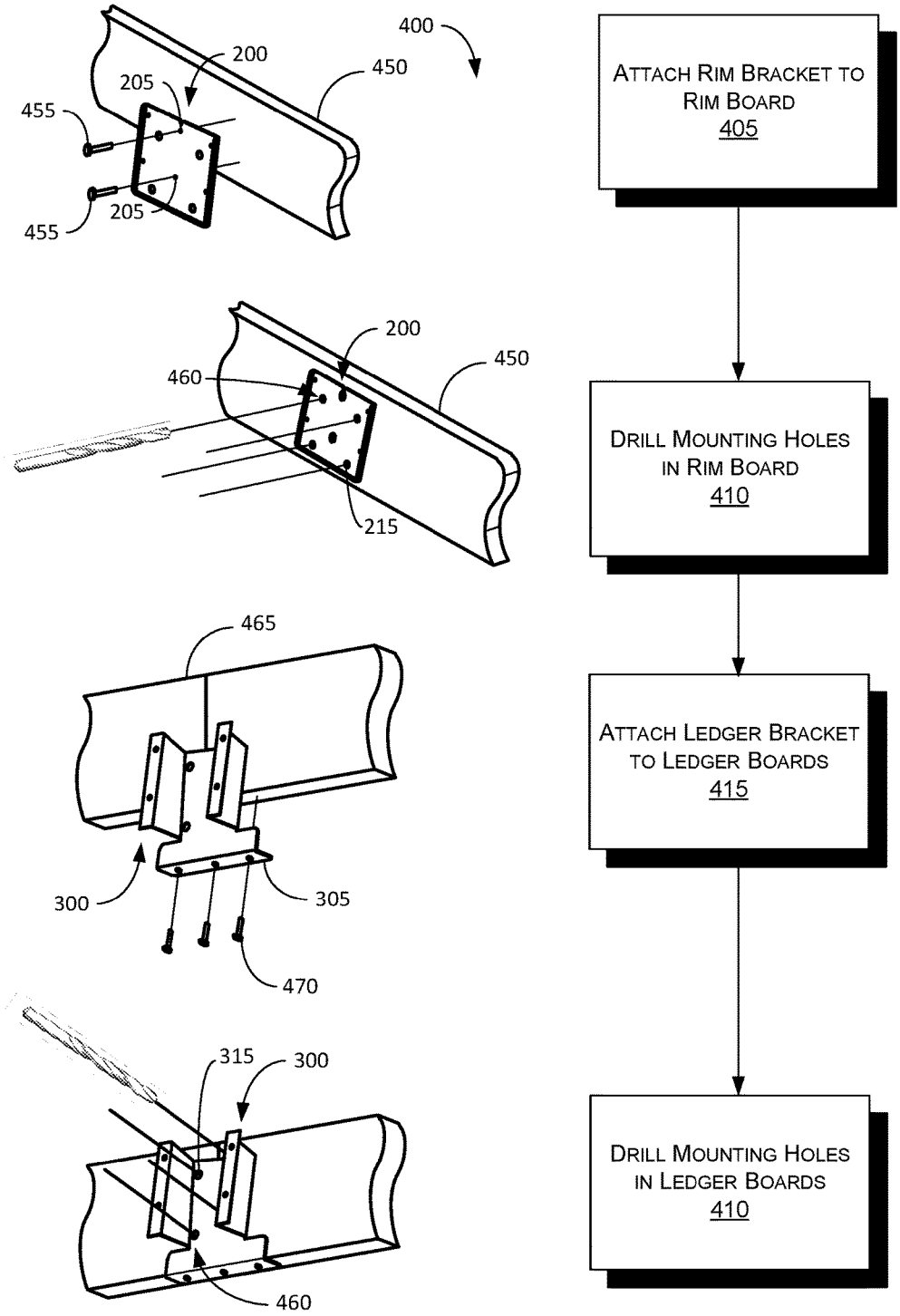
FIGS. 4A and 4B are flowcharts depicting a method for installing the splicing ledger board mounting bracket system, in accordance with some examples of the present disclosure.
Figure 4B:
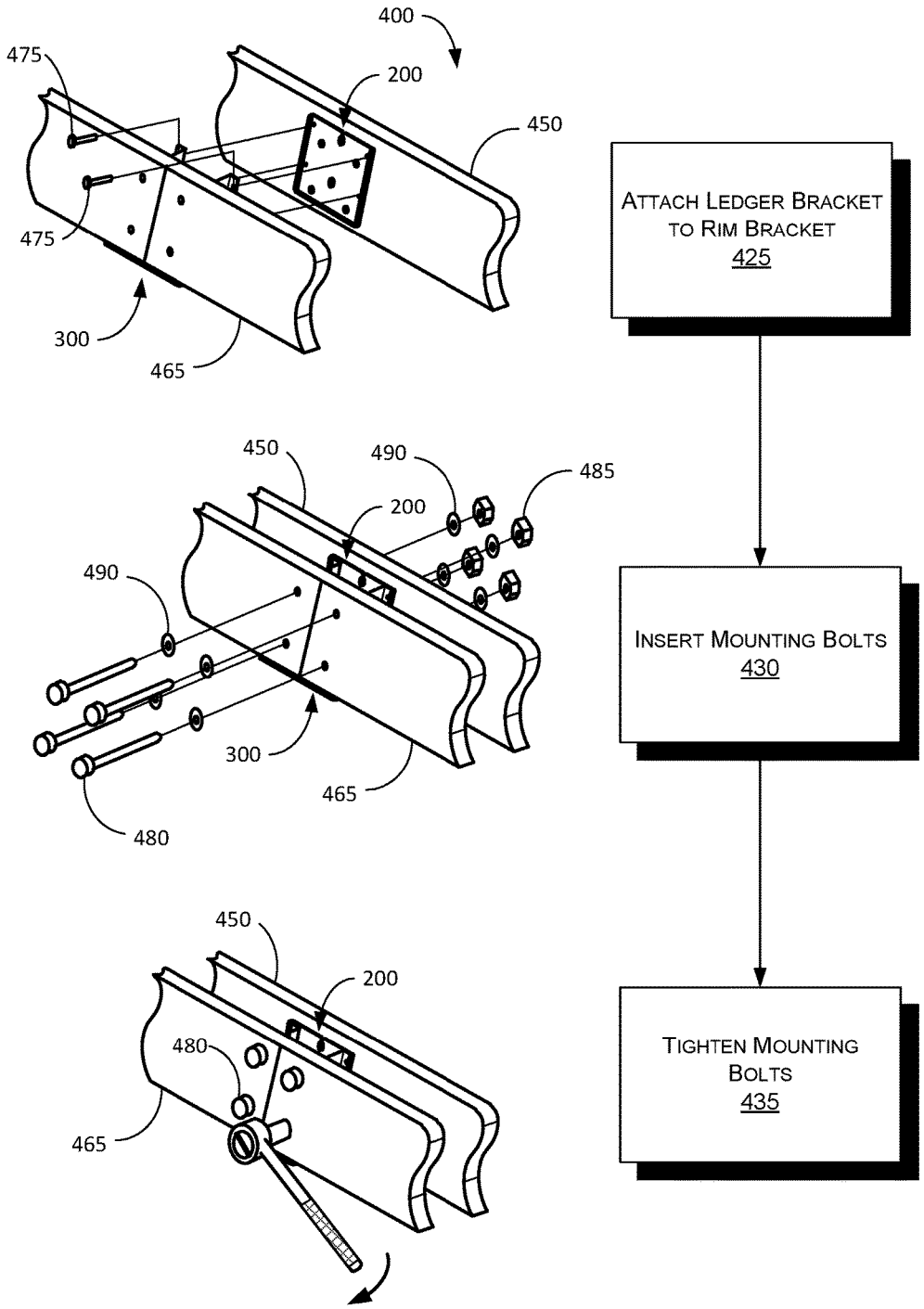

As discussed in more detail with reference to FIGS. 4A and 4*b*, below, the splicing ledger bracket 300 can include one or more mounting holes 315 for a first ledger board and one or more mounting holes 315 for a second ledger board to enable two ledger boards to be spliced together at the bracket 300. In some examples, as shown, the splicing ledger bracket 300 can comprise four mounting holes 315 to enable two bolts to be installed in each ledger board. In this manner, the ledger boards can be butted against one another, with two bolts in each, to provide a structural splice between the two boards. This can be useful when a deck is wider than can practically be supported by a single ledger board because, for example, the ledger board would be too long or heavy.

Conventional mounting brackets required two brackets, one on each end of the two ledger boards. This results in two brackets, and multiple mounting holes, in close proximity. This can make installation difficult. In addition, multiple mounting holes in close proximity can affect the strength of the rim board and other structures. The splicing ledger board subsystem 100, on the other hand, can enable two ledger boards to be spliced and mounted using a single ledger bracket subsystem 100. As a result, the splicing ledger board subsystem 100 reduces installation time, decreases cost (fewer brackets) and better maintains the strength of the structure, among other things.

Figure 3B:
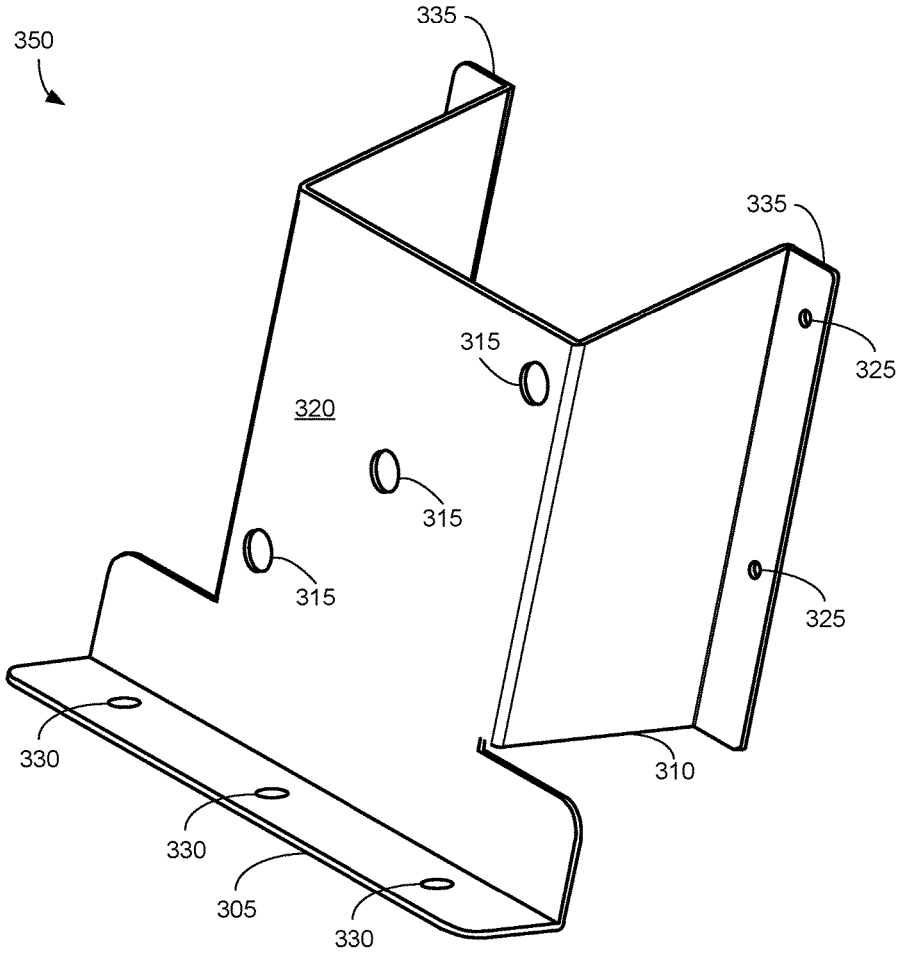
FIG. 3B is a perspective view of a non-splicing ledger bracket, in accordance with some examples of the present disclosure.

As shown in FIG. 3B, the non-splicing ledger board subsystem 150 can include a non-splicing ledger bracket 350. The non-splicing ledger bracket 350 can be substantially the same as the splicing ledger bracket 300, but can have fewer and/or differently spaced mounting holes 315. Because the non-splicing ledger bracket 350 is not responsible for splicing two ledger boards together, for example, the non-splicing ledger bracket 350 may have fewer and/or an odd number of mounting holes. The non-splicing ledger bracket 350 can be used when a single ledger board is sufficient for a particular deck, for example, or in the middle of a ledger board away from any splices.

In some examples, the splicing ledger bracket 300 and non-splicing ledger bracket 350 can also include one or more extensions 310. The extensions 310 can determine the distance between the ledger board and the rim board (i.e., the ledger board and the building structure). This can be useful, for example, to account for different building surface treatments.

Figure 3C:
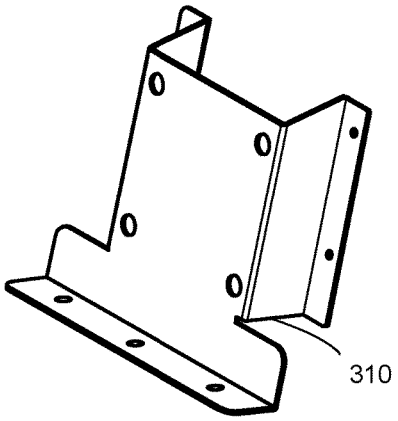
FIGS. 3C-3E are perspective views of a short, medium, and long ledger bracket, respectively, in accordance with some examples of the present disclosure.
Figure 3D:
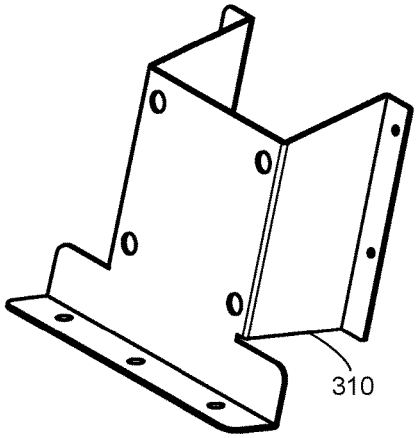
Figure 3E:
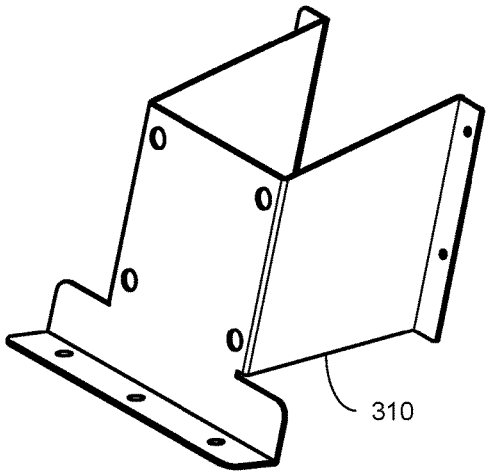

As shown in FIGS. 3C-3E, the extensions 310 on the splicing ledger bracket 300, for example, can be longer (i.e., increase the distance between the ledger board and the rim board) for siding such as, for example, brick, stone, or block, which is inherently thicker overall. If the building is to be sheathed in clapboards, on the other hand, the extensions 310 can be shorter. Thus, the splicing ledger board subsystem 100 can include ledger brackets 300 with varying length extensions 310 for different facades. The splicing ledger board subsystem 100 can include at least three ledger brackets 300, for example, short (FIG. 3B), medium (FIG. 3C), and long (FIG. 3D), depending on the thickness of the intended façade on the building. Brick or stone, for example, may use the long splicing ledger bracket 300 (FIG. 3D), while cement board siding may use the short splicing ledger bracket 300 (FIG. 3B). Indeed, the extensions 310 can be adjusted to the thickness of many surface treatments to enable the ledger board to be mounted at the desired distance from the rim board.

In addition, the extensions 310 enable the brackets 200, 250, 300, 350 to be installed on the building before the siding is installed to provide a smooth, plumb mounting surface and proper orientation. In other words, the extensions 310 enable the brackets 200, 250, 300, 350 to be installed on the sheathing for the building (e.g., oriented strand board (OSB) or plywood), which is relatively flat and plumb. The siding (e.g., bricks, stone, or siding) can then be installed around the brackets 200, 250, 300, 350 prior to the installation of the ledger board. This also prevents the ledger board from becoming damaged or stained during siding installation.

Returning back to FIG. 3A, the face plate 320 can further comprise one or more complementary mounting bolt holes 315. The complementary mounting bolt holes 315 can be substantially collocated with the rim board mounting holes 215 in the splicing rim bracket 200. In this manner, when the splicing ledger bracket 300 is attached to the splicing rim bracket 200, the rim board mounting holes 215 and the complementary mounting bolt holes 315 are substantially aligned enabling through-bolt holes to be drilled through the ledger board and the rim board to ease installation. In other words, because the brackets 200, 250, 300, 350 are self-aligning, they act as templates to enable properly aligned holes to be drilled in both the rim board and the ledger board separately. In addition, because the rim brackets 200, 250 can be attached to the rim board, the ledger brackets 300, 350 can be attached to the rim brackets 200, 250, and the rim board can be attached to the ledger brackets 300, 350 no holding and positioning of heavy lumber or beams is required.

Examples of the present disclosure can also comprise a method 400 for installing one or more ledger boards, or other supports, on a structure. At 405, the splicing rim bracket 200 can be installed on the rim board 450 (or other suitable component) of the structure using one or more fasteners 455 and the temporary mounting holes 205 on the rim bracket 200. In this manner, a relatively small component (i.e., the splicing rim bracket 200) can be installed on the structure and can be leveled, plumbed, and correctly positioned. In addition, while referred to as "temporary," the fasteners 455 can comprise lag screws, deck screws, or other fasteners that do provide additional strength to the splicing ledger board subsystem 100 yet do not require pre-drilled mounting holes to ease installation.

At 410, mounting holes 460 can be drilled in the rim board 450 using the rim board mounting holes 215 on the splicing rim bracket 200 as a template. In this manner, the mounting bolt holes 460 can be drilled without interference from the ledger board 465 or the other components of the splicing ledger board subsystem 100. In addition, the holes 460 can be accurately drilled because the splicing rim bracket 200 is attached to the rim board 4500. In other words, the splicing rim bracket 200 is substantially prevented from moving during drilling by the one or more fasteners 455, preventing misalignment of the mounting holes 460. Of course, a different number or pattern of mounting holes 215 can be used for different applications (e.g., when using the non-splicing rim bracket 250).

At 415, the ledger boards 465 can be attached to ledge 305 of the splicing ledger bracket 300 using one or more fasteners 470 and the ledger board mounting holes 330. The fasteners 470 can comprise lag or deck screws, for example, to connect the ledger boards 465 and the splicing ledger bracket 300 for installation. This can enable the ledger boards 465 to be spliced together when multiple ledger boards are used. This can also enable the ledger boards 465 and splicing ledger bracket 300 to be more easily lifted into place as a unit. The fasteners 470 can also prevent the ledger boards 465 from moving as the mounting holes 460 are drilled in the ledger boards 465, as described below. As discussed below, each ledger board 465 can receive two bolts 480, securely mounting and splicing the ledger boards 465.

At 420, the mounting bolt holes 460 can be drilled in the ledger boards 465 using the complementary ledger bracket mounting holes 315 in the splicing ledger bracket 300 as a drill guide. This can enable the holes 460 in the ledger board 465 to be drilled prior to lifting the board 465 into place. Yet, because the splicing rim bracket 200 and the splicing ledger bracket 300 having matching hole geometries, the mounting bolt holes 460 align when the splicing ledger board subsystem 100 is assembled. As discussed above, the fasteners 470 can also prevent the ledger boards 465 from moving as the mounting bolt holes 460 are drilled in the ledger board 465.

At 425, the ledger boards 465 and splicing ledger bracket 300 can be lifted into place and the splicing ledger bracket 300 can be attached to the splicing rim bracket 200 using one or more temporary fasteners 475. As before, the fasteners 475 can comprise, for example, deck or lag screw. In addition, while the fasteners 475 can provide some strength to the splicing ledger board subsystem 100, their primary function is to hold the brackets 200, 300 together and to support the ledger boards 465 until the mounting bolts 480 can be installed. The temporary fasteners—i.e., the fasteners 455 securing the splicing rim bracket 200 to the rim board 450, the fasteners 470 securing the ledger boards 465 to the splicing ledger bracket 300, and the fasteners 475 securing the splicing ledger bracket 300 to the splicing rim bracket 200—can be sufficiently strong to hold the ledger boards 465 and brackets 200, 300 in place while the mounting bolts 480 are installed, yet can be easily installed without pre-drilling holes, for example.

At 430, the mounting bolts 480 can be installed through the ledger boards 465, splicing ledger bracket 300, splicing rim bracket 200, and rim board 450, effectively mounting and splicing the two ledger boards 465 to the rim board 450. Nuts 485 and washers 490 can be used in the conventional manner to attach the splicing ledger board subsystem 100 to the rim board 450 and provide the necessary pullout strength (i.e., with the head of the bolt 480 and washer 490 on one side of the system and a nut 485 and washer 490 on the other side of the splicing ledger board subsystem 100). In some examples, as discussed below with respect to FIGS. 14A and 14B, a corner reinforcing bracket 1400 can also be used to further guard against pullout. The direction of installation of the mounting bolts 480 is immaterial, but conventionally, the mounting bolts 480 are installed from the outside of the structure, with the mounting nuts 485 placed inside the structure. Of course, the mounting bolt 480 could also comprise a threaded rod with nuts 485 and washers 490 on either end.

At 435, the nuts 485 and bolts 480 can be tightened to the required torque to splice the ledger boards 465 together and to attach the ledger boards 465 to the structure. In some examples, such as where required by code, the nuts 485 and bolts 480 can be tightened using an impact wrench, for example, or using a calibrated torque wrench to ensure the nuts 485 and bolts 480 are sufficiently tight.

The splicing ledger board subsystem 100 enables the ledger boards 465 to be attached to the building according to code requirements with increased accuracy, while reducing the time and labor required to install the ledger board 465. The splicing ledger board subsystem 100 also enables two ledger boards 465 to be spliced together and attached to the building using a single bracket, reducing installation time and cost. This can be useful when multiple ledger boards 465 are required to the length or configuration of a deck, for example. As discussed below, the ledger board 465 can then be used as an attachment point for additional components, such as rafters, railings, and flooring.

Figure 5:
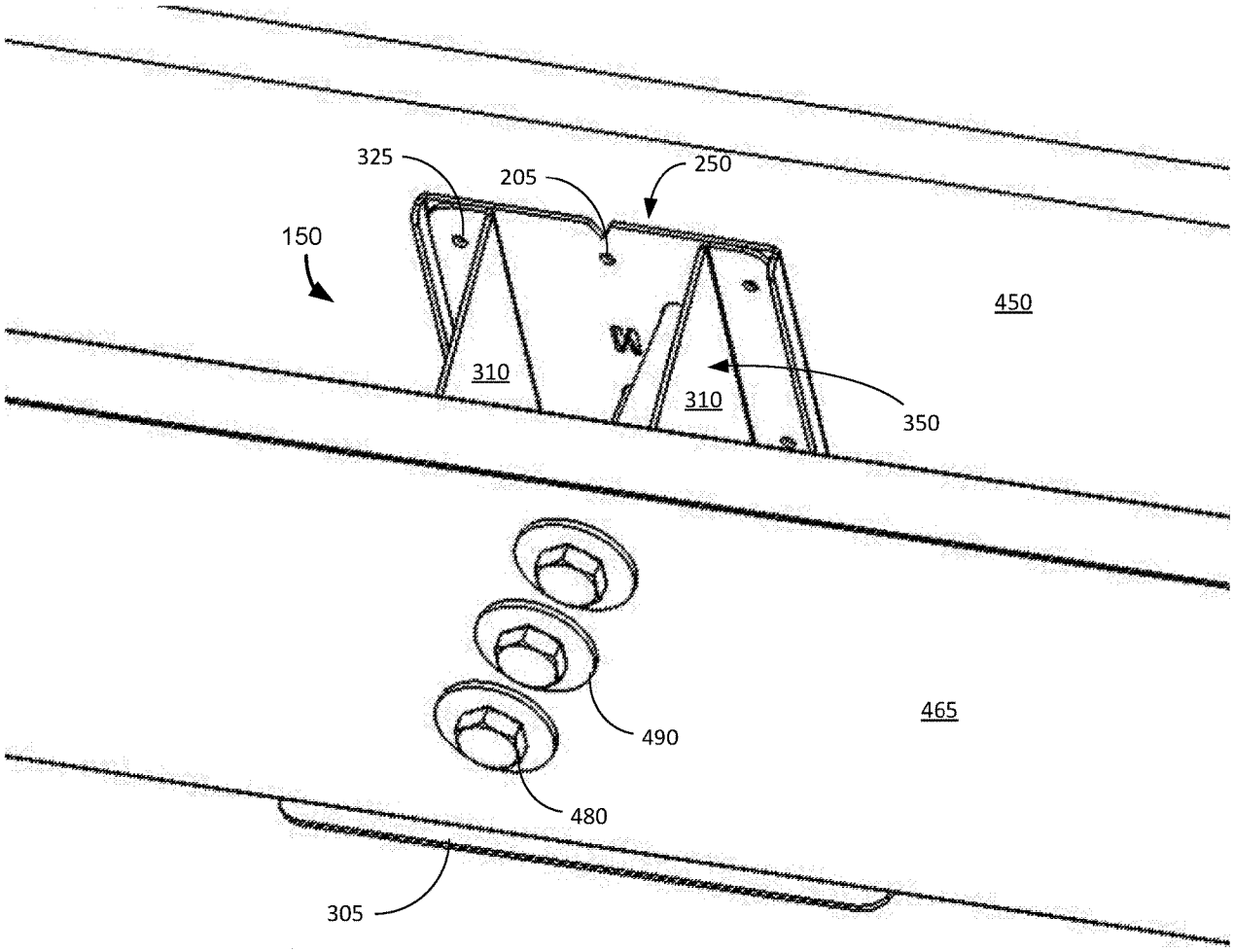
FIG. 5 is a perspective view of the non-splicing ledger board mounting system, in accordance with some examples of the present disclosure.

Similarly, as shown in FIG. 5, the non-splicing ledger board subsystem 150 enables the ledger board 465 to be temporarily attached to the rim board 450 by temporarily attaching the non-splicing ledger bracket 350 to the non-splicing rim bracket 250 with one or more fasteners 475. The ledger board 465 can then be permanently attached to the rim board 450 using one or more mounting bolts 480, nuts 485, and washers 490. Of course, other suitable fasteners and adhesives could also be used. The non-splicing ledger board subsystem 150 provides accurate alignment of the mounting holes 460 in both boards 450, 465 and also supports the ledger board 465 during installation of the mounting bolts 480, among other things. In addition, the extensions 310 on the non-splicing ledger bracket 350 provide proper spacing between the ledger board 465 and the rim board 450 to enable siding, decking, and other components to be installed on the building. The non-splicing ledger board subsystem 150 can be used when a single ledger board 465 is used, or in the middle of a ledger board 465 in concert with the splicing ledger board subsystem 100 (i.e., both subsystems 100, 150 can be used on at different locations on the same project).

Figure 6B:
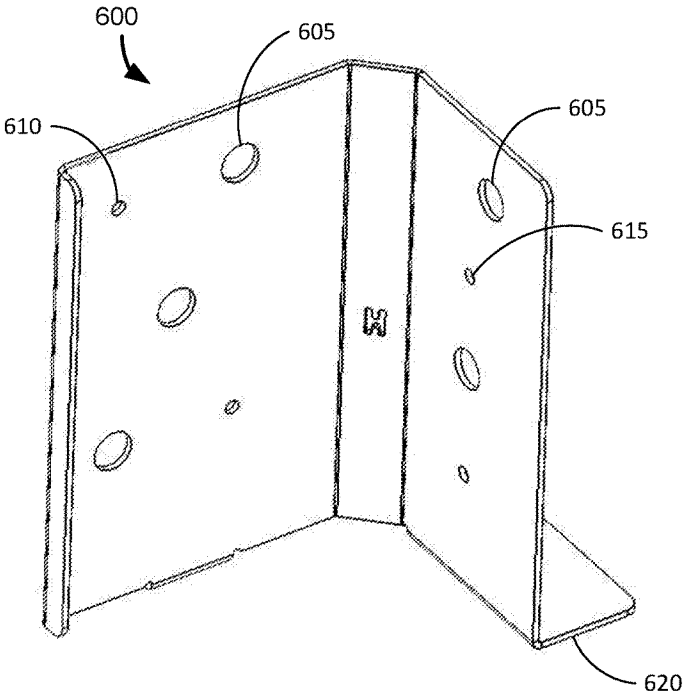
FIGS. 6A and 6B are perspective views of a ledger corner bracket, in accordance with some examples of the present disclosure.
Figure 6A:
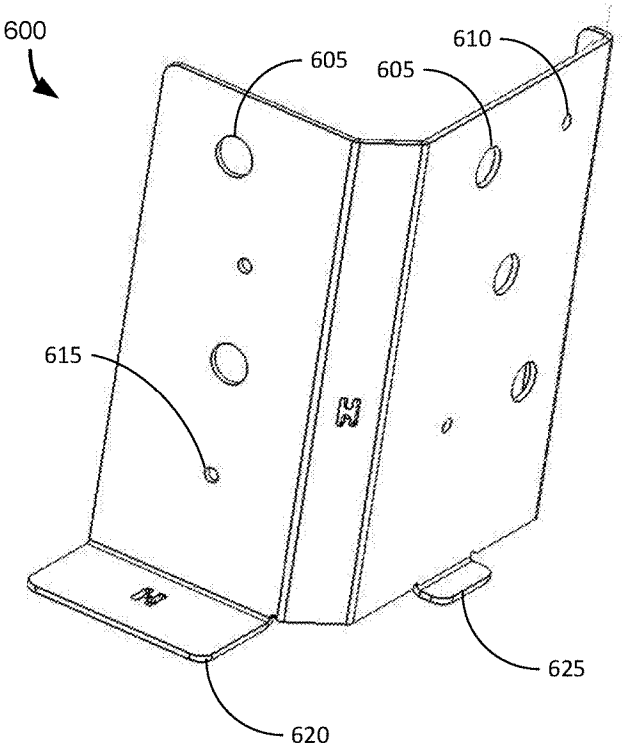

As shown in FIGS. 6A and 6B, the either subsystem 100, 150 can be installed using a number of additional components. In some examples, the non-splicing ledger board subsystem 150, for example, can be installed using a corner bracket 600. In this configuration, the non-splicing ledger board subsystem 150 can be installed on the rim board 450 of the structure with the ledger board 465 sandwiched between the non-splicing ledger bracket 350 and the corner bracket 600.

The corner bracket 600 can include, for example, a first face 602 and a second face 604 disposed at an angle to one another. In many cases, the first face 602 and the second face 604 can be disposed perpendicular (at a 90 degree angle) to one another. In other examples, the first face 602 and the second face 604 may be disposed at different angles to account for building shape or location, or other structures in the build location. In some examples, such as for a triangular deck, the first face 602 and the second face 604 may be disposed at an acute angle, such that the resulting outer joists converge at one end.

The first face 602 and the second face 604 can also comprise a plurality of mounting holes 605 in complementary locations to the rim and ledger board mounting holes 215, 315 on the brackets 250, 350. In this manner, the corner bracket 600 can also be installed using the mounting bolts 480. As with the other brackets 200, 250, 300, 350, the corner bracket 600 can also include a plurality of temporary mounting holes 610, 615 to enable the corner bracket 600 to be temporarily attached to the ledger board 465, for example, and to enable joists and other components to be temporarily attached to the corner bracket 600.

Like the ledger brackets 300, 350, the corner bracket 600 can also include a ledge 620. The ledge 620 can enable a joist or post, for example, to be supported and aligned by the corner bracket 600. In some examples, a joist can be attached to the corner bracket 600 using the temporary mounting holes 615 and supported by the ledge 620, while mounting holes are drilled in the joist using the mounting holes 605 in the corner bracket 600 as a template.

In some examples, the corner bracket 600 can also comprise an alignment tab 625. The alignment tab 625 can enable the corner bracket 600 to be aligned vertically on the ledger board 465, for example, to enable the mounting holes 460 to be accurately drilled. In this manner, the corner bracket 600 can act as both a support and a template for the system.

Figure 7:
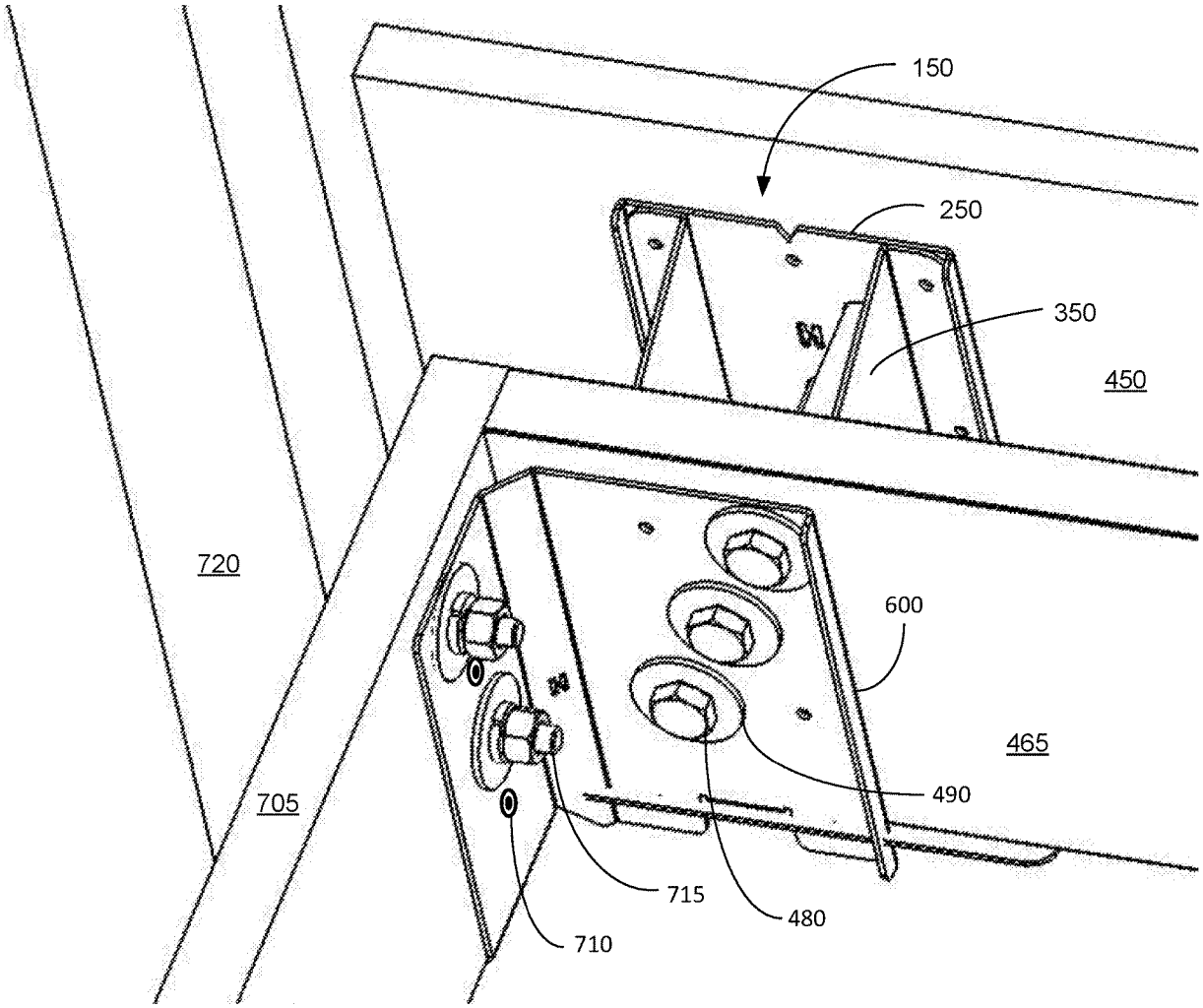
FIG. 7 is a detailed, top, perspective view of the ledger board mounting system with corner bracket, in accordance with some examples of the present disclosure.

As shown in FIG. 7, examples of the present disclosure can comprises a ledger board with corner bracket subsystem 700. As shown, the corner bracket 600 can provide an attachment point for an outer joist 705 of the deck (or other structure). In this configuration, the mounting bolts 480 can simultaneously attach (1) the ledger board 465 to the rim board 450 and (2) the corner bracket 500 to the ledger board 465. This both increases the strength of the ledger board subsystem 150 over convention joist hangers or corner brackets, but also reduces installation time and cost.

As shown, the ledge 620 of the corner bracket 600 can support the joist 705 during installation. In some examples, one or more temporary fasteners 710 can be used to attach the joist 705 to the corner bracket 600. This can enable the joist 705 to be attached to the corner bracket 600 prior to lifting the joist 705 into place, for example. In some examples, the mounting bolts 715 that mount the joist 705 to the corner bracket 600 can also mount to a post 720, or other support, further expanding and/or reinforcing the structure.

Figure 8:
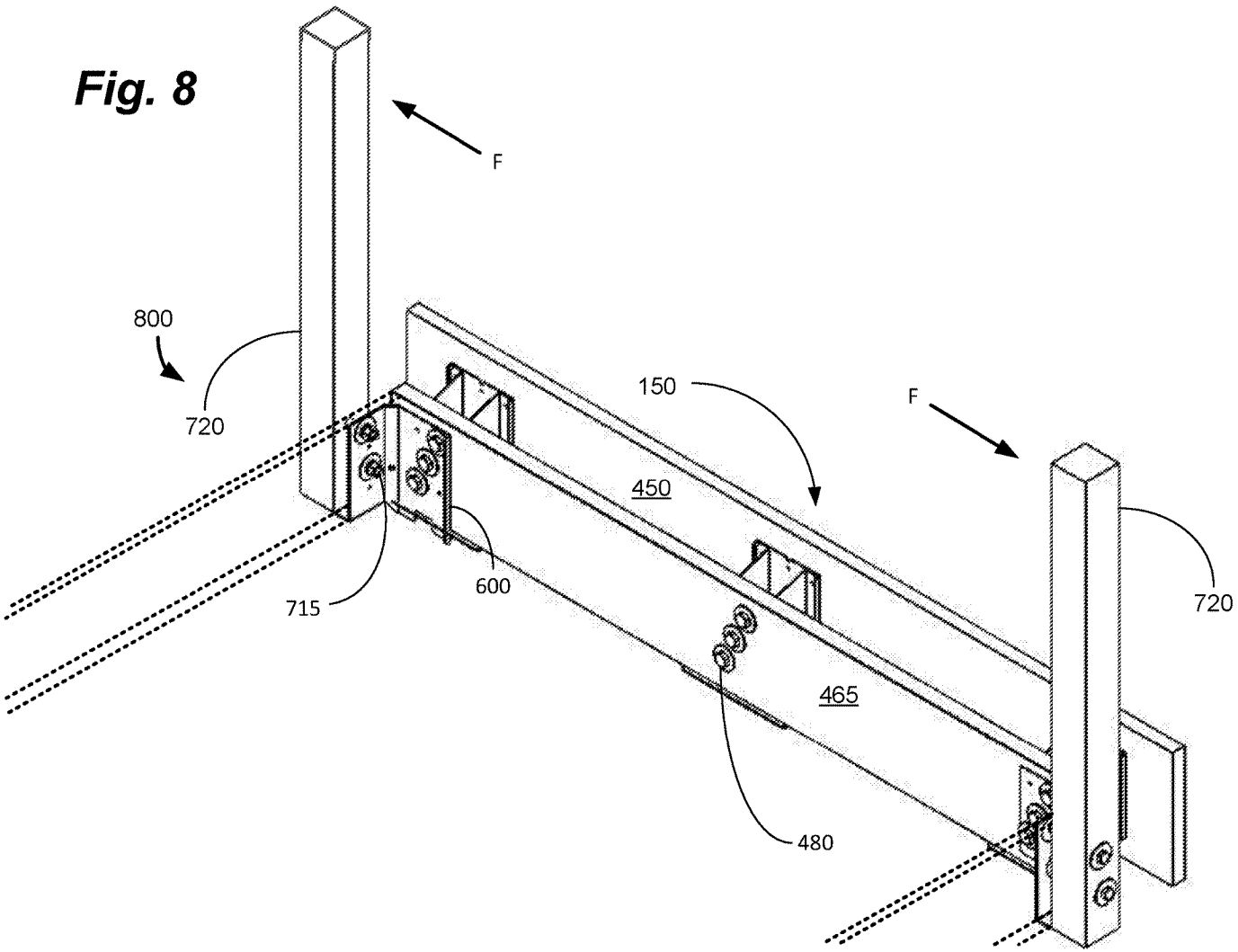
FIG. 8 is a top, perspective view of the ledger board mounting system with corner bracket of FIG. 7, in accordance with some examples of the present disclosure.

The outer joist subsystem 800 is depicted in FIG. 8. As shown, the middle portion of the ledger board 465 can be mounted to the rim board 450 using the non-splicing ledger board subsystem 150. The brackets 250, 350 enable the ledger board 465 to be attached using a plurality of mounting bolts 480. As mentioned above, the non-splicing ledger board subsystem 150 provides support for the ledger board 465 during installation and also acts as a template for drilling matching mounting holes 460 in the ledger board 465 and rim board 450.

As also shown in FIG. 8, the corners can be installed using the corner bracket subsystem 700. As discussed above, the corner bracket subsystem 700 can support a portion of the ledger board 465 and a joist 705, such as an outer floor joist for a deck. The corner bracket 600 can also provide an attachment point for a post 720, or other structure, that provides support for a railing, for example, roof, or second floor deck. The two mounting bolts 715 and corner bracket 600 can also enable the system 700 to meet code requirements for resisting lateral loads, F.

Figure 9B:
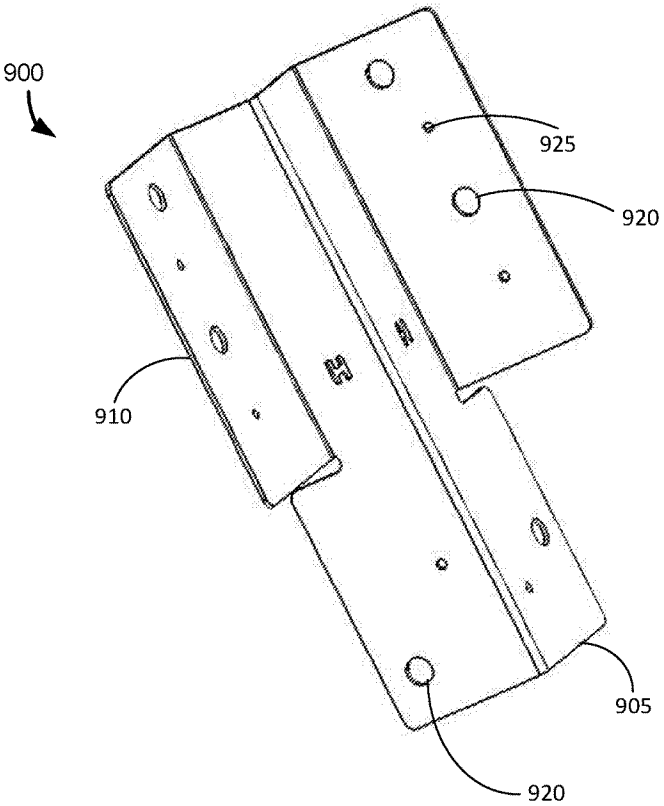
FIGS. 9A and 9B are perspective views of a single-level corner bracket, in accordance with some examples of the present disclosure.
Figure 9A:
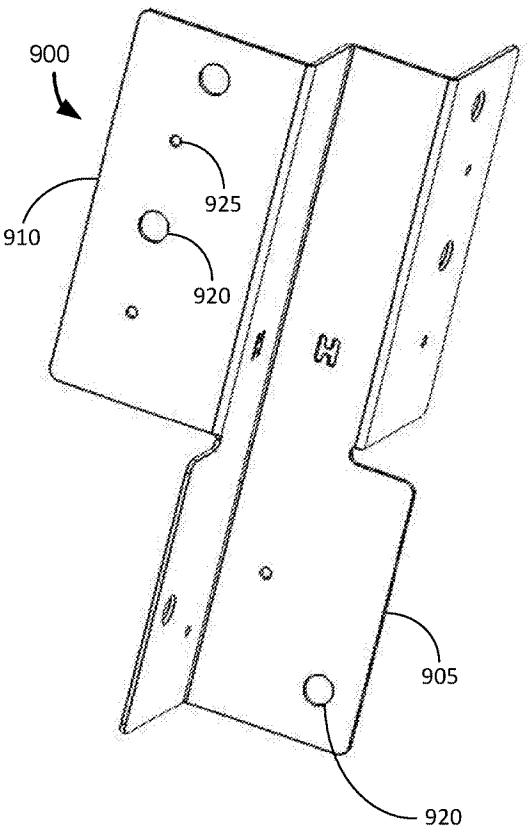

As shown in FIGS. 9A and 9B, in still other examples, the either ledger board subsystem 100, 150 can be used with one or more outer corner brackets 900. The outer corner brackets 900 can comprise a central L-shaped main bracket 905 and one or more mounting pads 910. In this manner, the outer corner bracket 900 can be attached to the corner post of a deck, for example, using one or more mounting holes 915. The mounting pads 910, in turn, can enable a rim joist, joists, and/or rail posts to be attached to the corner bracket 900 using a plurality of mounting holes 920.

As before, the outer corner bracket 900 can also include one or more temporary mounting holes 925 to enable the bracket 900 to be temporarily attached to the joists or rails. In this manner, the mounting holes 920 can act as a template for drilling complementary mounting holes 460 in the rim joist, joists, and/or rail posts. In addition, the rim joist, joists, and/or rail posts can be temporarily supported by the outer corner bracket 900 until mounting holes 460 can be drilled and mounting bolts 480 can be installed for permanent installation.

Figure 10:
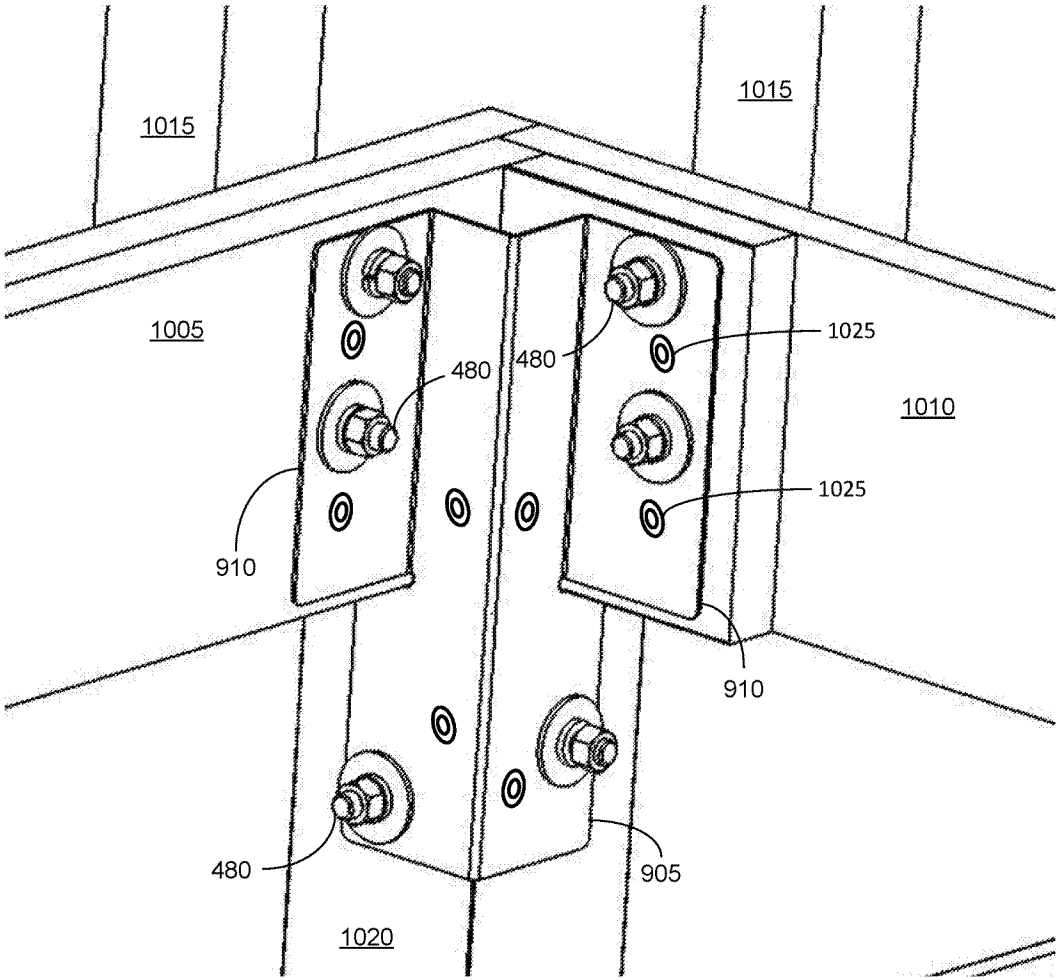
FIG. 10 is a perspective, detail view of the single-level corner bracket of FIGS. 9A and 9B installed on a deck system, in accordance with some examples of the present disclosure.

As shown in FIG. 10, the outer corner subsystem 1000 can enable the rim joist 1005, outer joist 1010, and corner posts 1015 to be attached to a support 1020. In some examples, the outer corner bracket 900 can be attached to the support 1020—e.g., a steel post, 4×4, 6×6, or other support—using one or more temporary fasteners 1025. Similarly, the outer joist 1010 and rim joist 1005 can be attached to the outer corner bracket 900 using temporary fasteners 1025. This can enable the outer joist 1010 and rim joist 1005 to be temporarily supported and can enable the outer corner bracket 900 to act as a template for one or more mounting holes 460. Once drilled, the outer joist 1010 and rim joist 1005 can be permanently attached to the support 1020 using one or more mounting bolts 480 (and nuts 485 and washers 490) and the outer corner bracket 900.

Figure 11B:
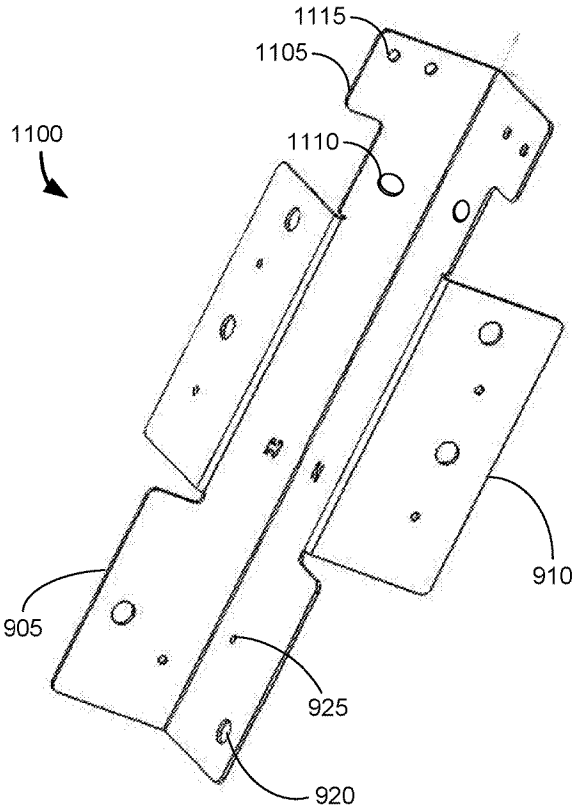
FIGS. 11A and 11B are perspective views of a multi-level corner bracket, in accordance with some examples of the present disclosure.
Figure 11A:
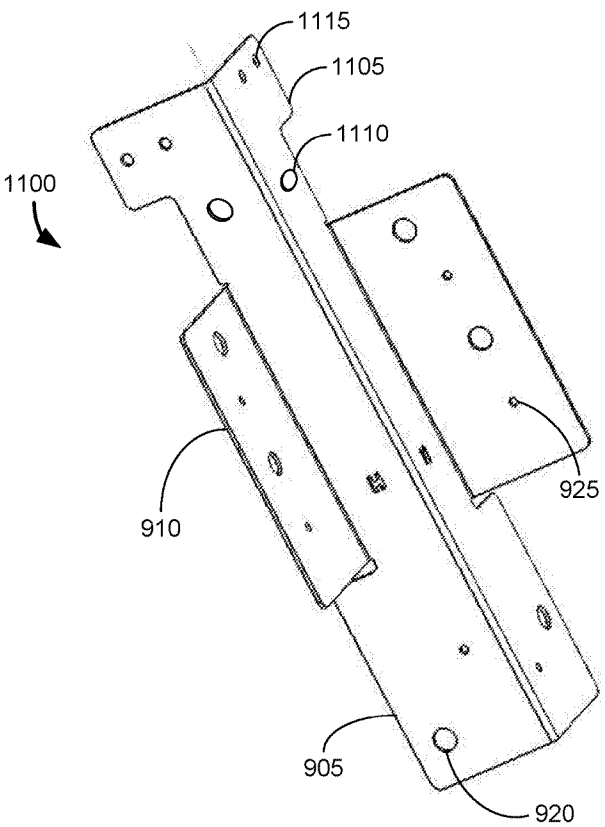

As shown in FIGS. 11A and 11B, either subsystem 100, 150 can also utilize a multi-level corner bracket 1100 for multi-story decks, decks with roofs, or decks with other multi-story features. In this configuration, the multi-level corner bracket 1100 can have substantially the same components as those listed above for the outer corner bracket 900, but can add an extension 1105 to the central L-shaped main bracket 905. The extension 1105 can enable the bracket 1100 to be attached to a multi-level support, or to add a second support to provide a multi-story deck feature (e.g., another floor or a roof). The multi-level corner bracket 1100 can comprise one or more mounting holes 1110 and one or more temporary mounting holes 1115.

Figure 12:
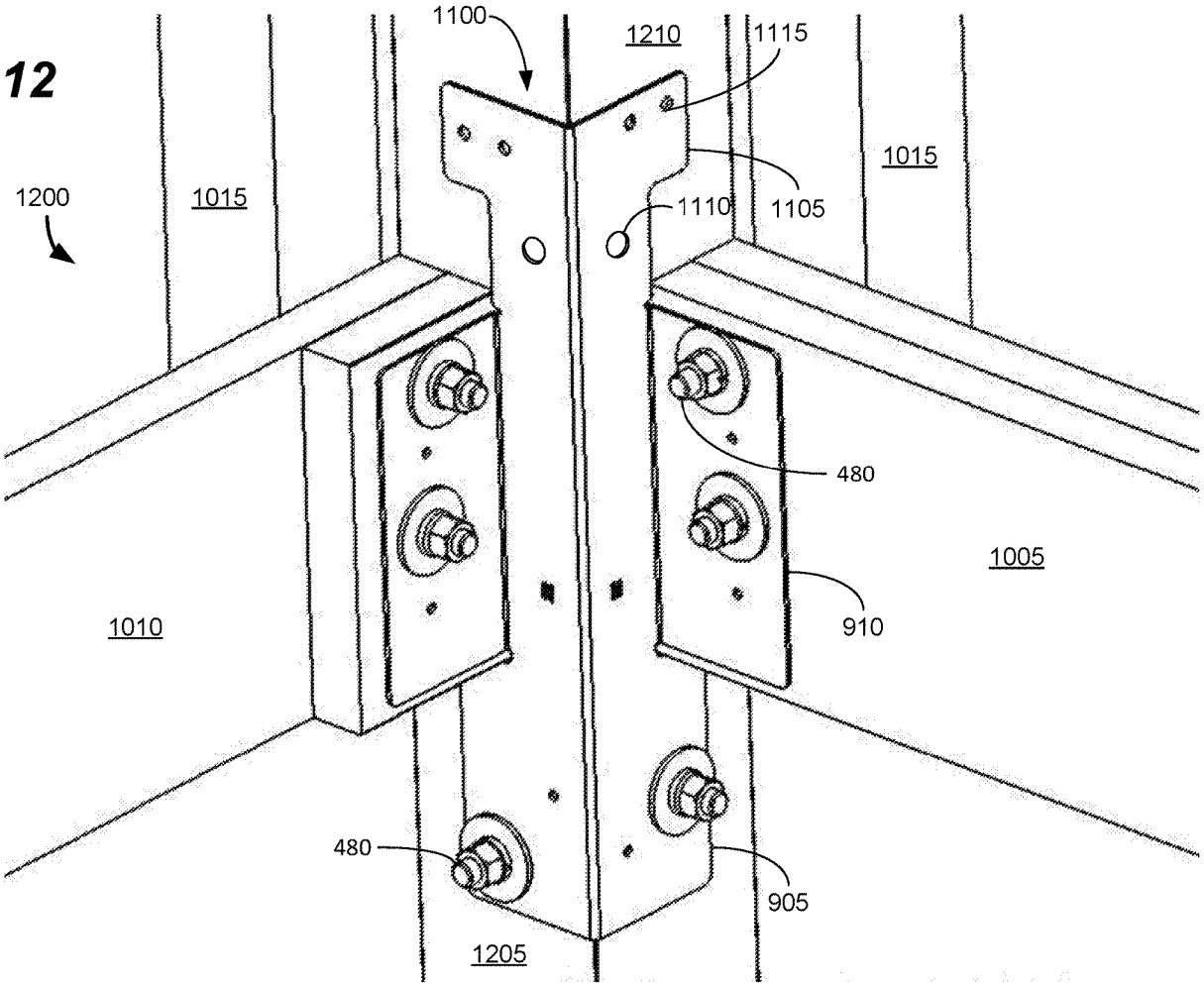
FIG. 12 is a perspective, detail view of the multi-level corner bracket of FIGS. 11A and 11B installed on a deck system, in accordance with some examples of the present disclosure

As shown in FIG. 12, therefore, the multi-story subsystem can attach the outer joist 1010 and rim joist 1005 to the multi-level corner bracket 1100. To begin installation, the outer joist 1010 and rim joist 1005 can be attached to the multi-level corner bracket 1100 using temporary fasteners 1025. This can enable the outer joist 1010 and rim joist 1005 to be temporarily supported and can enable the multi-level corner bracket 1100 to act as a template for one or more mounting holes 460. Once drilled, the outer joist 1010 and rim joist 1005 can be permanently attached to the support 1205 using one or more mounting bolts 480 (and nuts 485 and washers 490).

In some examples, the mounting bolts 460 can also secure one or more posts 1015. The posts 1015 can enable a railing to be attached, for example, or can provide support for additional components. As shown, the posts 1015 can be bolted to the outside of the outer joist 1010 and rim joist 1005, though the posts 1015 can also be bolted to the inside of the outer joist 1010 and rim joist 1005. As mentioned above, the mounting bolts 460 can enable the posts 1015 to meet code requirements for lateral loads (e.g., people leaning on the railing or posts 1015).

In addition, using the extension 1105, the multi-level corner bracket 1100 can also be attached to a second support 1210. In some examples, the support 1205 can support the first floor of the deck or structure, while the second support 1210 can support the second story or roof of the deck or structure. In this configuration, the multi-level corner bracket 1100 can provide additional mounting bolt holes (not shown) for mounting bolts 460 and nuts 485 to secure the second support 1210 to the multi-level corner bracket 1100. In this manner, the multi-level corner bracket 1100 can enable the support 1205 and the second support 1210 to be attached together and to support the he outer joist 1010 and rim joist 1005, among other things. In other examples, the support 1205 and the second support 1210 can comprise a single, multi-level support (e.g., a single post or pole of increased height). Regardless, the multi-level subsystem 1200 can enable a support post 1205, 1210 for a second story deck, roof, or other structure to be secured to the same bracket 1100 as the first floor.

Any of the brackets 200, 250, 300, 350, 600, 900, 1100 can be, for example, stamped and folded, cast, machined, or printed. The brackets 200, 250, 300, 350, 600, 900, 1100 can comprise steel, aluminum, stainless steel, fiberglass, polymer, carbon fiber composites, or combinations thereof. In some examples, the brackets 200, 250, 300, 350, 600, 900, 1100 can be, for example, galvanized, painted, or powder coated. In some examples, the brackets 200, 250, 300, 350, 600, 900, 1100 can be color-coded by load rating, installation order, or installation location, among other things. The brackets 200, 250, 300, 350, 600, 900, 1100 are described above as being attached to components using bolts, screws, lag screws, and other fasteners. Of course, other fasteners and means of fastening could also be used including, but not limited to, staples, nails, and adhesives.

Figure 13:
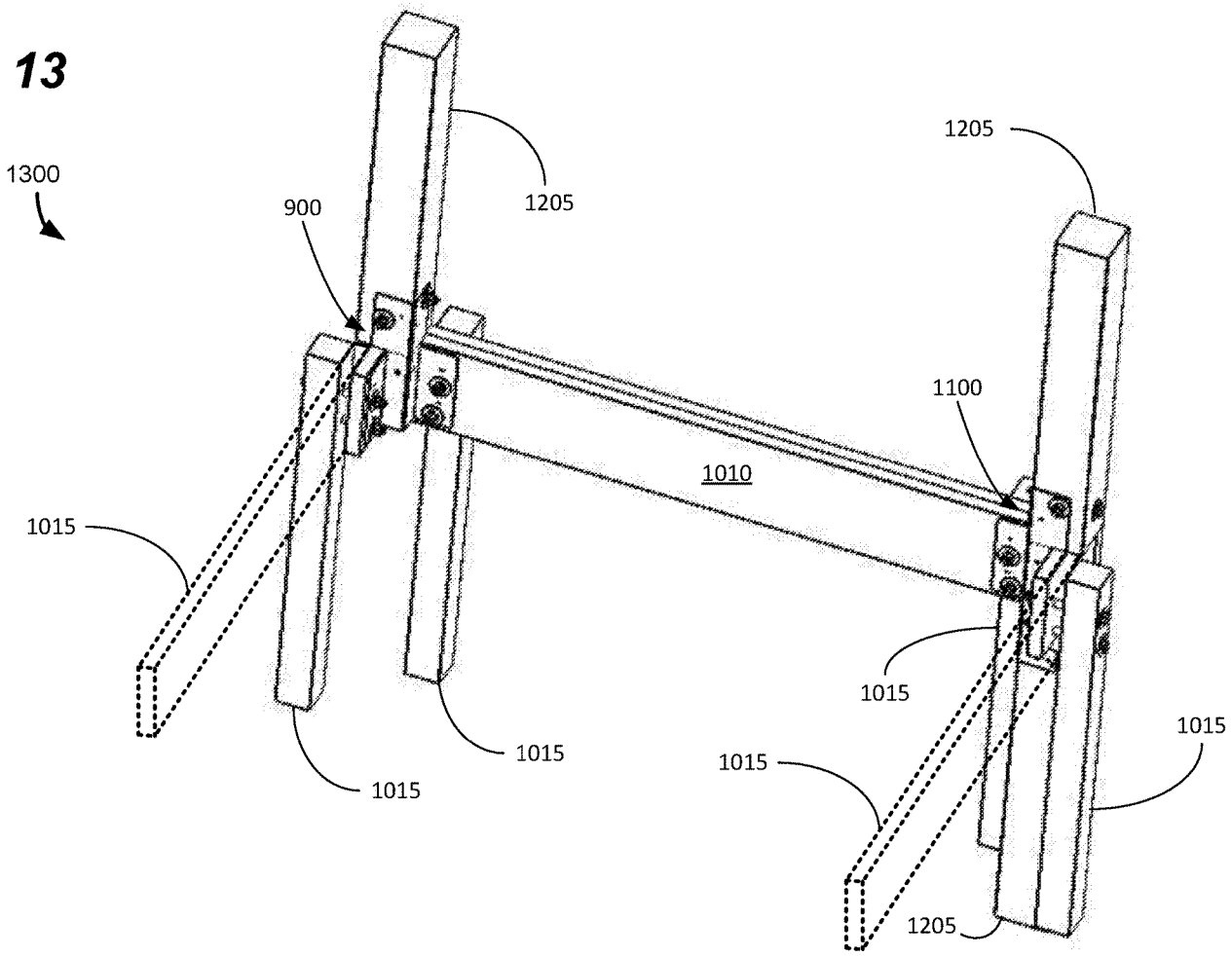
FIG. 13 is a front, perspective view of a rim joist subsystem, in accordance with some examples of the present disclosure.

As shown in FIG. 13, therefore, the rim joist subsystem 1300 can comprise one or more outer corner brackets 900 and/or one or more multi-level corner brackets 1100. The rim joist subsystem 1300 can enable the posts 1015, outer joists 1010 (shown dotted for clarity), and/or rim joist 1005 to be attached to one or more supports 1205, 1210. The rim joist subsystem 1300 can enable the posts 1015, outer joists 1010 (shown dotted for clarity), and/or rim joist 1005 to be temporarily attached to the outer corner brackets 900 and/or one or more multi-level corner brackets 1100. The outer corner brackets 900 and/or one or more multi-level corner brackets 1100 can then act as templates to enable mounting holes 460 to be accurately drilled into the posts 1015, outer joists 1010, and/or rim joist 1005. Mounting bolts 480 can then be used to permanently attach these components 1015, 1010, 1015 to the outer corner brackets 900 and/or one or more multi-level corner brackets 1100.

Figure 14A:
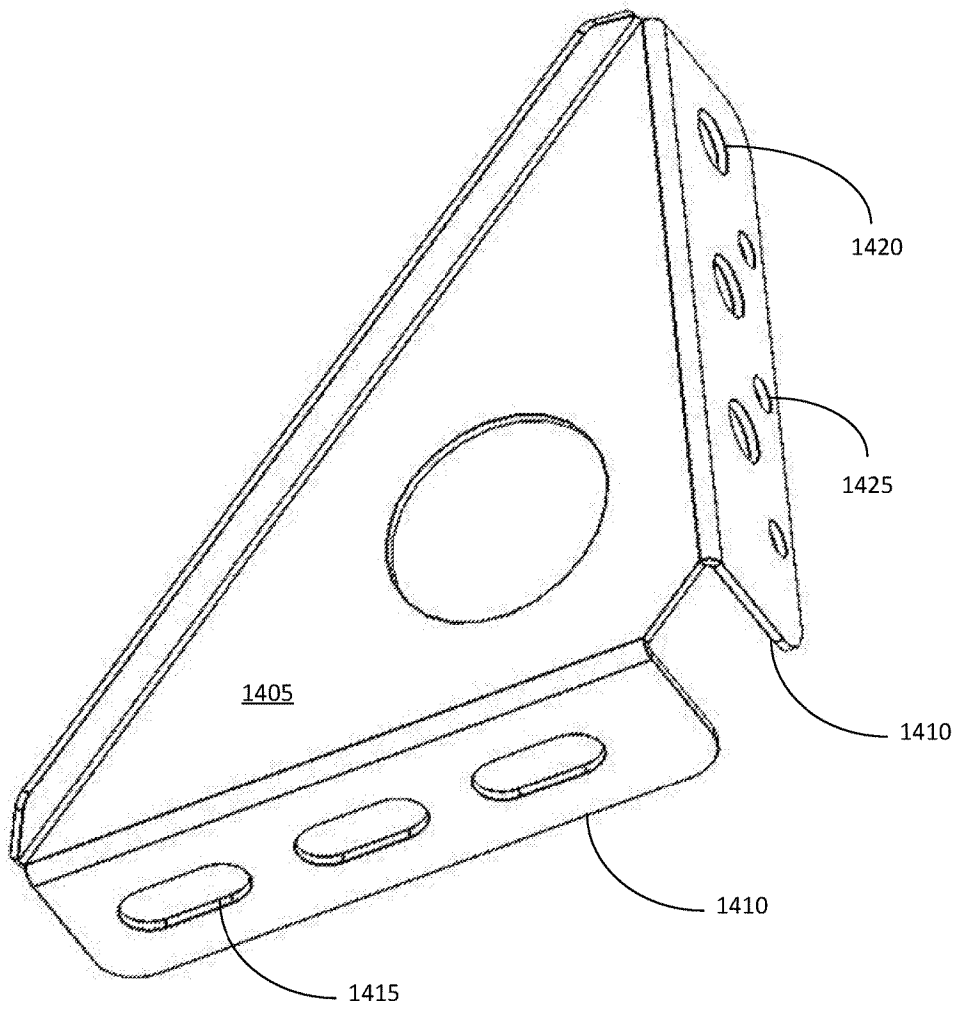
FIGS. 14A and 14B depict a corner reinforcing bracket, in accordance with some examples of the present disclosure.
Figure 14B:
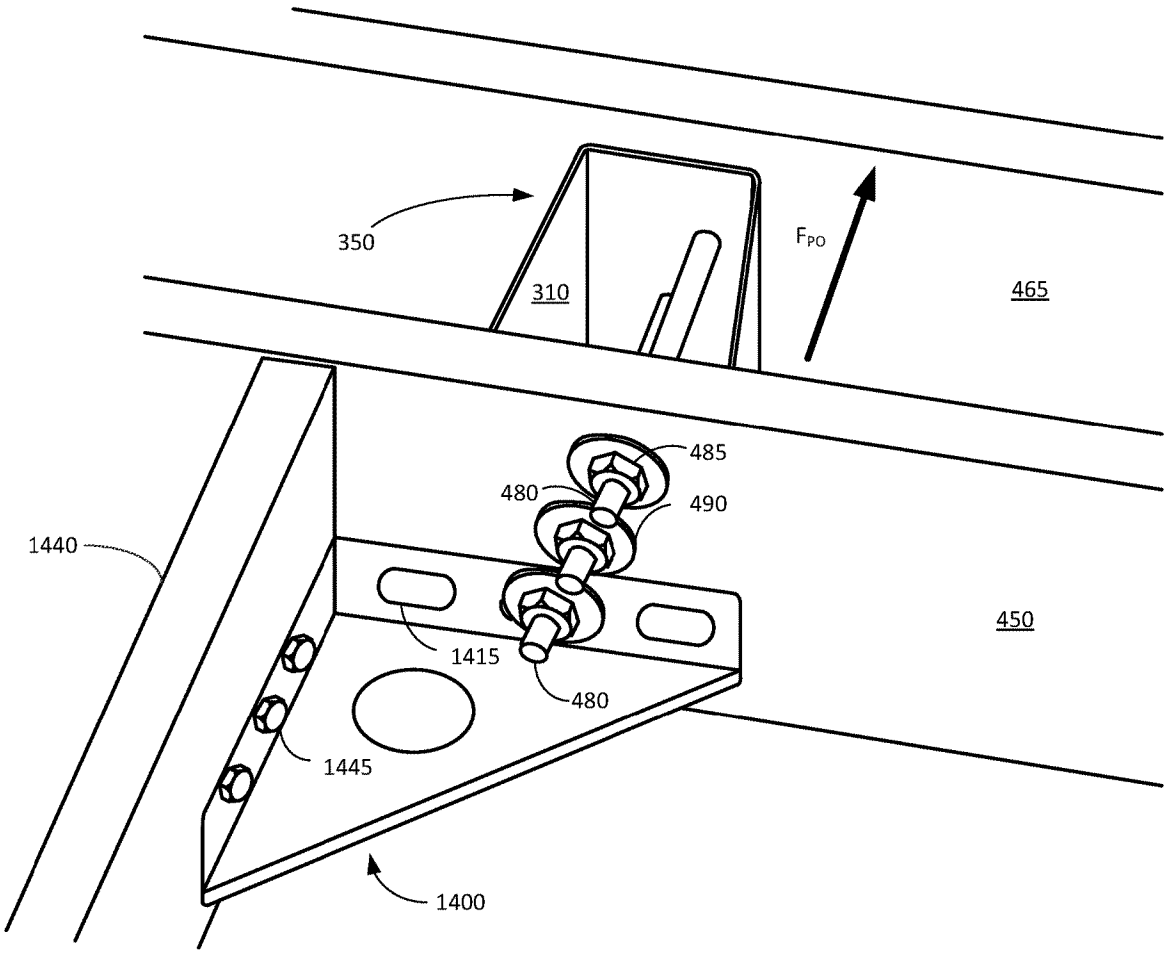

As shown in FIGS. 14A and 14B, in some jurisdictions, the system 100 may be subject to an additional pullout requirement. The 2009 IRC, for example, now requires that at least two locations on the deck have a hold-down tension rating of at least 1500 pounds. In other words, as shown in FIG. 14B, the ledger board 465 must resist a pullout force, $F_{PO}$, of at least 1500 pounds in at least two locations. To this end, in some examples a corner reinforcing bracket 1400 can be used.

The corner reinforcing bracket 1400 can comprise a main body 1405, one or more mounting tabs 1410, one or more mounting slots 1415, one or more mouthing holes 1420, and one or more temporary mounting holes 1425. In some examples, the mounting slots 1415 can be used to mount the corner reinforcing bracket 1400 to the rim board 450 using one or more of the existing mounting bolts 480 and nuts 485 and to a floor joist 1440 of the structure using additional bolts 1445. The slots 1415 can enable the position of the corner reinforcing bracket 1400 to be adjusted slightly to align with the joist 1440.

In some examples, the one or more temporary mounting holes 1425 can enable the corner reinforcing bracket 1400 to be temporarily attached to the joist 1440 to ease installation. Once in place, the one or more mounting holes 1420 can be used to permanently attach the corner reinforcing bracket 1400 to the joist 1440 using through bolts 1445, lag bolts, or other suitable means. Due to the design of the corner reinforcing bracket 1400, $F_{PO}$ acts on the bolts 1445 in sheer, thus reducing the tendency of the subsystem 100 and ledger board 465 to pull out. In addition, the load path is carried directly through the bracket 1400 to the joist 1440 for the subsystem 100 creating a very strong, pullout resistant joist mount.

Figure 15:
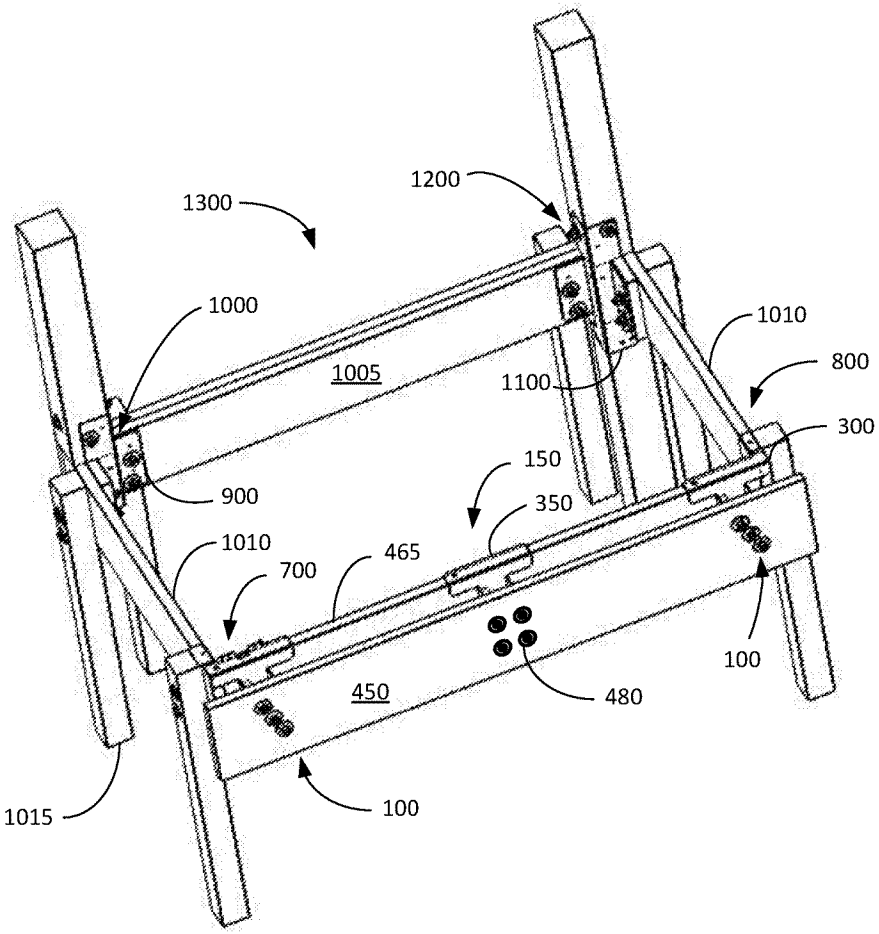
FIG. 15 is a rear, perspective view of a complete deck attachment and assembly system, in accordance with some examples of the present disclosure.

The complete deck support system 1500 is shown from below in FIG. 15. The deck support system 1500 enables a deck, or other structure, to be firmly attached to a building using code approved methods, while reducing installation time and effort. The system 1500 can include multiple subsystems for mounting the ledger board (e.g., both the splicing ledger board subsystem 100 and non-splicing ledger board subsystem 150), the corners of the deck (corner bracket subsystem 700), the outer joists of the deck (outer joist subsystem 800), and the outer corners of the deck—i.e., the corners away from the building (the outer corner subsystem 1000). The deck support system 1500 can also comprise a subsystem for supporting an additional floor or roof for a deck (multi-level subsystem 1200) and the rim joist of the deck (rim joist subsystem 1300).

The system 1500 can comprise a splicing rim bracket 200 and a splicing ledger bracket 300 for attaching the two ledger boards 465 to a rim board 450. The system 1500 can also include one or more non-splicing rim brackets 250 and non-splicing ledger bracket 350 to join other parts of the ledger board 465, or when a single ledge board ban be used. Thus, the splicing 100 and non-splicing 150 subsystems can be used in concert depending on mounting location and deck configuration.

The system 1500 can also comprise a corner bracket 600 to attach the outer joist 1010 and/or posts 1015 to the ledger board 465. The system 1500 can also comprise single—900 and multi-level 1100 outer corner brackets to enable the rim joist 1005 to be coupled to the outer joists 1010 and to provide an attachment point for posts 1015 and one or more supports 1205, 1210. In some examples, the system 1500 can also comprise one or more corner reinforcing brackets 1400 to further reinforce the outer joists 1010 (or, indeed, any joist) against pullout.

Examples of the present disclosure, therefore, can comprise splicing 100 and non-splicing 150 ledger board subsystems. These subsystems 100, 150 can be used to attach one or more ledger boards 465 to the rim boards 450, or other structural components, of existing structures. Theses subsystems 100, 150 can use additional subsystems 700, 800, 1000, 1200, 1300 to form a complete mounting system 1500 for a deck or other structure. The system 1500 can enable decks and other structures to be mounted to existing structures in less time, without lower cost, and at a higher strength.

While several possible embodiments are disclosed above, embodiments of the present invention are not so limited. For instance, while several possible configurations of materials for the brackets have been disclosed, other suitable materials and combinations of materials could be selected without departing from the spirit of embodiments of the invention. In addition, the location and configuration used for various features of embodiments of the present disclosure can be varied according to a particular deck or roof design that requires a slight variation due to, for example, the size or construction of the deck, the building materials, and site variations. Such changes are intended to be embraced within the scope of the invention.

The specific configurations, choice of materials, and the size and shape of various elements can be varied according to particular design specifications or constraints requiring a device, system, or method constructed according to the principles of the invention. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

The invention claimed is:

1. A mounting system comprising:
- a rim bracket, disposed proximate a rim board on a structure, the rim bracket comprising:
  - a main, substantially planar, body defining one or more rim board mounting holes; and
  - a ledger bracket, disposed proximate a ledger board to be attached to the structure, the ledger bracket comprising:
  - two flanges;
  - two extensions, each with a first end and a second end, the first end of each of the two extensions disposed proximate the two flanges;
  - a face plate disposed on the second end of each of the one or more extensions and defining one or more ledger board mounting holes; and
  - a ledge, extending from a bottom of the face plate, to support a ledger board during installation such that the ledger board is substantially parallel to the rim board;
  - wherein the one or more rim board mounting holes and the one or more ledger board mounting holes are substantially aligned when the ledger bracket is installed on the rim bracket.

2. The system of claim 1, wherein the rim bracket further comprises one or more temporary mounting holes to enable the rim bracket to be temporarily mounted to the rim board during installation.

3. The system of claim 1, wherein the rim bracket further comprises one or more ledger bracket mounting holes; and
- wherein the ledger bracket further comprises one or more complementary mounting holes to enable the ledger bracket to be temporarily attached to the rim bracket with one or more fasteners during installation.

4. The system of claim 1, wherein the rim bracket further comprises one or more side lips extending from the main body of the rim bracket and substantially perpendicular to the rim bracket to laterally locate the ledger bracket during installation.

5. The system of claim 1, wherein the rim bracket further comprises a bottom lip for temporarily supporting the ledger bracket during installation.

6. The system of claim 1, wherein the two extensions comprise:
- one or more short extensions to space the ledger board from the rim board a first distance;
- one or more medium extensions to space the ledger board from the rim board a second distance; or
- one or more long extensions to space the ledger board from the rim board a third distance;
- wherein the first distance is shorter than the second distance; and
- wherein the second distance is shorter than the third distance.

7. The system of claim 1, further comprising a fastener extending through the ledger board, a first ledger board mounting hole of the one or more ledger board mounting holes, a first rim board mounting hole of the one or more rim board mounting holes, and the rim board to detachably couple the ledger board to the rim board on the structure.

8. A mounting system comprising:
- a ledger bracket;
- a rim bracket, disposed proximate a rim board on a structure, the rim bracket comprising:
  - a main, substantially planar, body, with first end and a second end, defining one or more rim bracket mounting holes and one or more rim board mounting holes;

a first side lip, disposed vertically proximate the first end of the main body, the first side lip extending from the main body of the rim bracket and substantially perpendicular to the rim bracket to laterally locate the ledger bracket during installation;

the ledger bracket, disposed proximate a ledger board to be attached to the structure, the ledger bracket comprising:

a first flange disposed proximate the first side lip and parallel to the main body and defining one or more flange bracket mounting holes;

a second flange disposed proximate the second side lip and parallel to the main body and defining one or more additional flange bracket mounting holes;

a first extension, with a first end and a second end, the first end of the first extension disposed proximate the first flange, the first extension extending outwardly from the first extension and substantially perpendicular to the main body and the first flange;

a second extension, with a first end and a second end, the first end of the second extension disposed proximate the second flange, the second extension extending outwardly from the second extension and substantially perpendicular to the main body and the second flange;

a face plate disposed on the second end of the first extension and second extension and defining one or more ledger board mounting holes; and a ledge, extending from a bottom of the face plate, to support a ledger board during installation such that the ledger board is substantially parallel to the rim board;

wherein the one or more rim board mounting holes and the one or more ledger board mounting holes are substantially aligned when the ledger bracket is installed on the rim bracket.

9. The mounting system of claim 8, further comprising:

a second side lip, disposed vertically proximate the second end of the main body, the second side lip extending from the main body of the rim bracket and substantially perpendicular to the rim bracket to laterally locate the ledger bracket during installation.

10. The mounting system of claim 8, wherein the one or more rim bracket mounting holes are smaller than the one or more rim board mounting holes.

11. The mounting system of claim 8, wherein the one or more ledger bracket mounting holes are smaller than the one or more ledger board mounting holes.

* * * * *